US009783960B2

(12) United States Patent
Shimizu et al.

(10) Patent No.: US 9,783,960 B2
(45) Date of Patent: Oct. 10, 2017

(54) DRIVING DEVICE FOR WORK MACHINE

(71) Applicant: Hitachi Construction Machinery Co., Ltd., Bunkyo-ku, Tokyo (JP)

(72) Inventors: Juri Shimizu, Tokyo (JP); Teppei Saitoh, Tokyo (JP); Mariko Mizuochi, Tokyo (JP); Kenji Hiraku, Tsuchiura (JP); Akinori Ishii, Tsuchiura (JP); Hiromasa Takahashi, Tsuchiura (JP); Takashi Kusama, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 97 days.

(21) Appl. No.: 14/771,870

(22) PCT Filed: Sep. 1, 2014

(86) PCT No.: PCT/JP2014/072925
§ 371 (c)(1),
(2) Date: Sep. 1, 2015

(87) PCT Pub. No.: WO2015/030234
PCT Pub. Date: Mar. 5, 2015

(65) Prior Publication Data

US 2016/0032565 A1 Feb. 4, 2016

(30) Foreign Application Priority Data

Sep. 2, 2013 (JP) ..... 2013-181182

(51) Int. Cl.
*E02F 9/22* (2006.01)
*F15B 11/17* (2006.01)
*F15B 11/042* (2006.01)

(52) U.S. Cl.
CPC ..... *E02F 9/22* (2013.01); *E02F 9/2242* (2013.01); *E02F 9/2267* (2013.01);
(Continued)

(58) Field of Classification Search
CPC ..... F15B 21/14; F15B 19/00; F15B 11/04; F15B 21/00; F15B 11/00; F15B 11/05;
(Continued)

(56) References Cited

U.S. PATENT DOCUMENTS 4,369,625 A * 1/1983 Izumi ..... E02F 9/2292 414/699
4,410,057 A * 10/1983 Johnson ..... B62D 5/32 180/406

(Continued)

FOREIGN PATENT DOCUMENTS

JP 56-127803 A 10/1981
JP 58-72506 U 5/1983
WO WO 2005/024246 A1 3/2005

OTHER PUBLICATIONS

International Search Report (PCT/ISA/210) dated Nov. 25, 2014 with English-language translation (four (4) pages).

*Primary Examiner* — Thomas E Lazo
(74) *Attorney, Agent, or Firm* — Crowell & Moring LLP

(57) ABSTRACT

To provide a driving device capable of improving the operability of a plurality of single rod hydraulic cylinders. The present invention takes a construction provided with a closed circuit A in which first and third hydraulic pumps 12, 14 and a boom cylinder 1 are connected through selector valves 43*a*, 45*a* in a closed-circuit fashion, a plurality of open circuits E, F provided with second and fourth hydraulic pumps 13, 15 and selector valves 44*a*, 46*a* that switch the supply destinations of hydraulic oils flowing out from the second and fourth hydraulic pumps 13, 15, and a connection passage 301 connected to sides of the selector valves 44*a*, 46*a* from which sides hydraulic oil flows out, and connected to the closed circuit A.

5 Claims, 6 Drawing Sheets

(52) U.S. Cl.
CPC ..... *E02F 9/2278* (2013.01); *E02F 9/2289* (2013.01); *E02F 9/2292* (2013.01); *E02F 9/2296* (2013.01); *F15B 11/042* (2013.01); *F15B 11/17* (2013.01); *F15B 2211/20561* (2013.01); *F15B 2211/20576* (2013.01); *F15B 2211/27* (2013.01); *F15B 2211/3059* (2013.01); *F15B 2211/7135* (2013.01)

(58) Field of Classification Search
CPC ..... F15B 13/042; F15B 11/028; F15B 13/02; F15B 2211/20561; F15B 2211/20546; F15B 2211/20538; E02F 9/22
USPC ..... 60/422, 430, 476, 484
See application file for complete search history.

(56) References Cited

U.S. PATENT DOCUMENTS 4,561,249 A * 12/1985 Watanabe ..... B66C 13/18 417/216
5,299,420 A * 4/1994 Devier ..... E02F 9/22 137/596.16
6,886,332 B2 * 5/2005 Kubinski ..... F15B 7/08 60/475
7,578,127 B2 * 8/2009 Griswold ..... F15B 7/006 60/422
8,726,645 B2 * 5/2014 Shang ..... E02F 9/123 60/414
9,441,646 B2 * 9/2016 Shin ..... E02F 9/2235
2007/0205026 A1 * 9/2007 Lee ..... E02F 9/2242 180/6.48
2012/0260641 A1 * 10/2012 Opdenbosch ..... E02F 9/2217 60/327
2013/0098463 A1 4/2013 Kuehn et al.
2013/0255244 A1 * 10/2013 Shin ..... E02F 9/2235 60/459
2013/0312399 A1 * 11/2013 Hiraku ..... F15B 15/18 60/422
2015/0135697 A1 * 5/2015 Shimizu ..... E02F 9/2235 60/425

* cited by examiner

DRIVING DEVICE FOR WORK MACHINE

TECHNICAL FIELD

The present invention relates to a driving device for driving a work machine such as, for example, a hydraulic excavator and particularly, to a driving device for a work machine having a plurality of closed circuits in each of which a single rod hydraulic cylinder and a closed-circuit hydraulic oil outflow/inflow control section are connected in a closed circuit fashion.

BACKGROUND ART

In recent years, in work machines such as hydraulic excavators, there is known a hydraulic circuit, a so-called closed circuit, in which connections in a closed circuit fashion are made to feed hydraulic oil from a hydraulic pump being a pressure generating source directly to a single rod hydraulic cylinder being a hydraulic actuator and in which the hydraulic oil after used in driving the single rod hydraulic cylinder to perform a given work is returned directly to the single rod hydraulic cylinder. On the other hand, as opposed to the closed circuit, there is also known a hydraulic circuit, a so-called open circuit, in which hydraulic oil is fed from a hydraulic pump to a single rod hydraulic cylinder through a throttle configured by a control valve and in which the return hydraulic oil from the single rod hydraulic cylinder is drained into a tank. Compared with the hydraulic circuit of the open circuit type, the hydraulic circuit of the closed circuit type is advantageous in fuel consumption performance because a pressure loss caused by a throttle is little and because regeneration by the hydraulic pump is possible with the energy that the return hydraulic oil from the single rod hydraulic cylinder possesses.

Further, Patent Literature 1 discloses prior art in which closed circuits of this kind are combined. In Patent Literature 1, there is installed a first closed circuit in which a hydraulic pump being an oil pump for operating a boom cylinder being a single rod hydraulic cylinder is connected to the boom cylinder in a closed circuit fashion, and there is also installed a second closed circuit in which a hydraulic pump for operating an arm cylinder being a single rod hydraulic cylinder is connected to the arm cylinder in closed circuit fashion. Furthermore, an open circuit is installed in which a hydraulic pump for operating a bucket cylinder being a single rod hydraulic cylinder is connected to the bucket cylinder through a control valve, and a distribution circuit that distributes the hydraulic oil discharged from the hydraulic pump of the open circuit to the boom cylinder and the arm cylinder is provided to branch from a side closer to the hydraulic pump than the control valve in the open circuit.

CITATION LIST

Patent Literature

Patent Literature 1: WO 2005/024246

SUMMARY OF INVENTION

Technical Problem

In the prior art disclosed in the aforementioned Patent Literature 1, one open circuit is placed in juxtaposition with a plurality of closed circuits like the first and second closed circuits. Thus, in comparison with the case where one closed circuit alone operates a given single rod hydraulic cylinder, the hydraulic oil discharged from the hydraulic pump of the open circuit can be distributed through the distribution circuit, and hence, it becomes possible to increase the moving speed of the single rod hydraulic cylinder. However, in Patent Literature 1, in a so-called combination operation wherein a plurality of single rod hydraulic cylinders are driven simultaneously, there is a likelihood that the hydraulic oils to be distributed become unstable in flow rate because the flow rate of the hydraulic oil distributed from the open circuit runs short or because a given operating pressure is unable to supply. Therefore, there arises an anxiety that these plural single rod hydraulic cylinders do not become stable in behavior, whereby the operability is degraded.

The present invention has been made taking the aforementioned circumstances in the prior art into consideration, and an object thereof is to provide a driving device for a work machine capable of improving the operability of a plurality of single rod hydraulic cylinders.

Solution to Problem

In order to attain this object, the present invention is a driving device for a work machine including: a plurality of closed circuits including at least one closed-circuit hydraulic oil outflow/inflow control section having two outflow/inflow ports enabling the outflow/inflow of hydraulic oil in both directions and at least one single rod hydraulic cylinder having a first hydraulic oil chamber and a second hydraulic oil chamber and, the two outflow/inflow ports of the closed-circuit hydraulic oil outflow/inflow control section are connected to the first hydraulic oil chamber and the second hydraulic oil chamber to form the closed circuit; a plurality of open circuits including at least one open-circuit hydraulic oil outflow/inflow control section having an inflow port in which hydraulic oil flows from a tank, and an outflow port from which hydraulic oil flows out, and an open-circuit switching section that switches supply destinations of the hydraulic oil flowing out from the open-circuit hydraulic oil outflow/inflow control section; and a controller that controls the closed-circuit hydraulic oil outflow/inflow control section, the open-circuit hydraulic oil outflow/inflow control section and the open-circuit switching section; wherein the driving device features further comprising a connection passage that is connected to a side from which hydraulic oil flows out, of the at least one open-circuit switching section of the plural open circuits and any of the plural closed circuits.

In the present invention constructed like this, the connection passage is connected to the side from which hydraulic oil flows out, of the at least one open-circuit switching section of the plural open circuits, and this connection passage is connected to any of the plural closed circuits. Thus, even when, for example, a plurality of single rod hydraulic cylinders are made to be driven, the controller suitably controls the open-circuit hydraulic oil outflow/inflow control sections and the open-circuit switching sections of the plural open circuits, so that the hydraulic oils that flow out from the open-circuit hydraulic oil outflow/inflow control sections of these plural open circuits can be reliably supplied to the single rod hydraulic cylinders to be driven. Accordingly, since the flow rates of the hydraulic oils that outflow from these open circuits to the single rod hydraulic cylinders become hard to run short, these single rod hydraulic cylinders can be stabilized in behavior, and these single rod hydraulic cylinders can be improved in operability.

Effects of Invention

The present invention takes a construction that the connection passage is connected to the side from which hydraulic oil flows out, of the at least one open-circuit switching section of the plural open circuits and that the connection passage is connected to any of the plural closed circuits. With this construction, in the present invention, even when, for example, a plurality of single rod hydraulic cylinders are made to be driven, the controller suitably controls the open-circuit hydraulic oil outflow/inflow control sections and the open-circuit switching sections of the plural open circuits, so that the hydraulic oils that flow out from the open-circuit hydraulic oil outflow/inflow control sections of these plural open circuits can be reliably supplied to the single rod hydraulic cylinders to be driven. Accordingly, since the flow rates of the hydraulic oils that flow out from these open circuits to the single rod hydraulic cylinders become hard to run short, these single rod hydraulic cylinders can be stabilized in behavior, and these single rod hydraulic cylinders can be improved in operability. Further, other problems, constructions and effects than those aforementioned will become better understood by reference to the following description of the embodiments.

DESCRIPTION OF EMBODIMENTS

Hereinafter, embodiments of the present invention will be described with reference to the drawings.

First Embodiment

Figure 1:
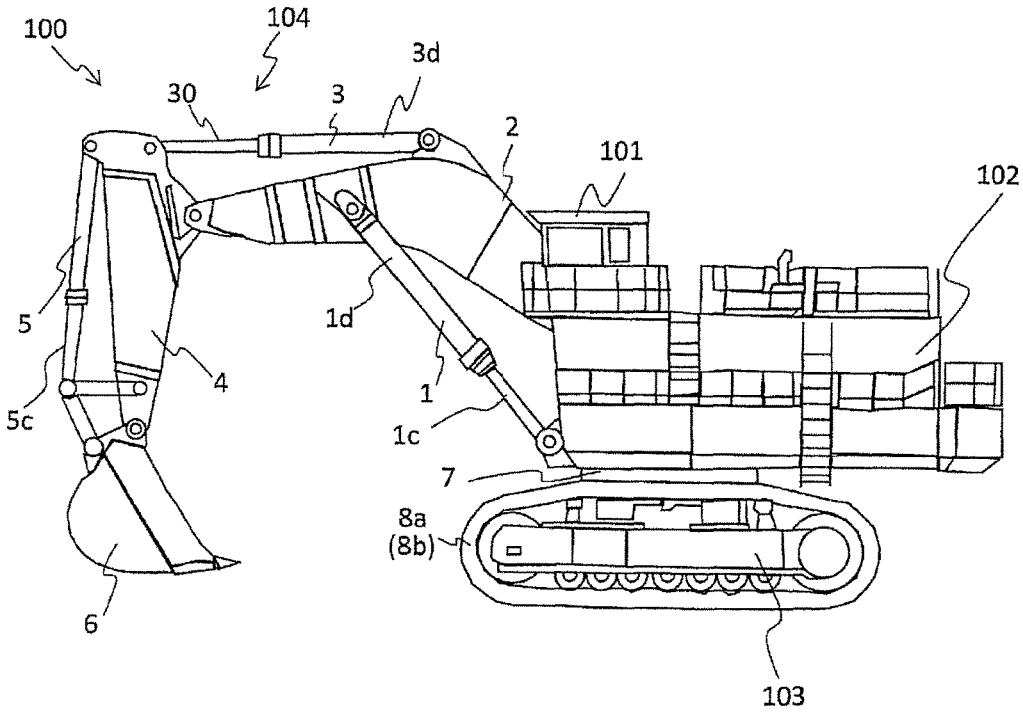
FIG. 1 is a schematic view showing a hydraulic excavator equipped with a driving device for a work machine according to a first embodiment of the present invention.
Figure 2:
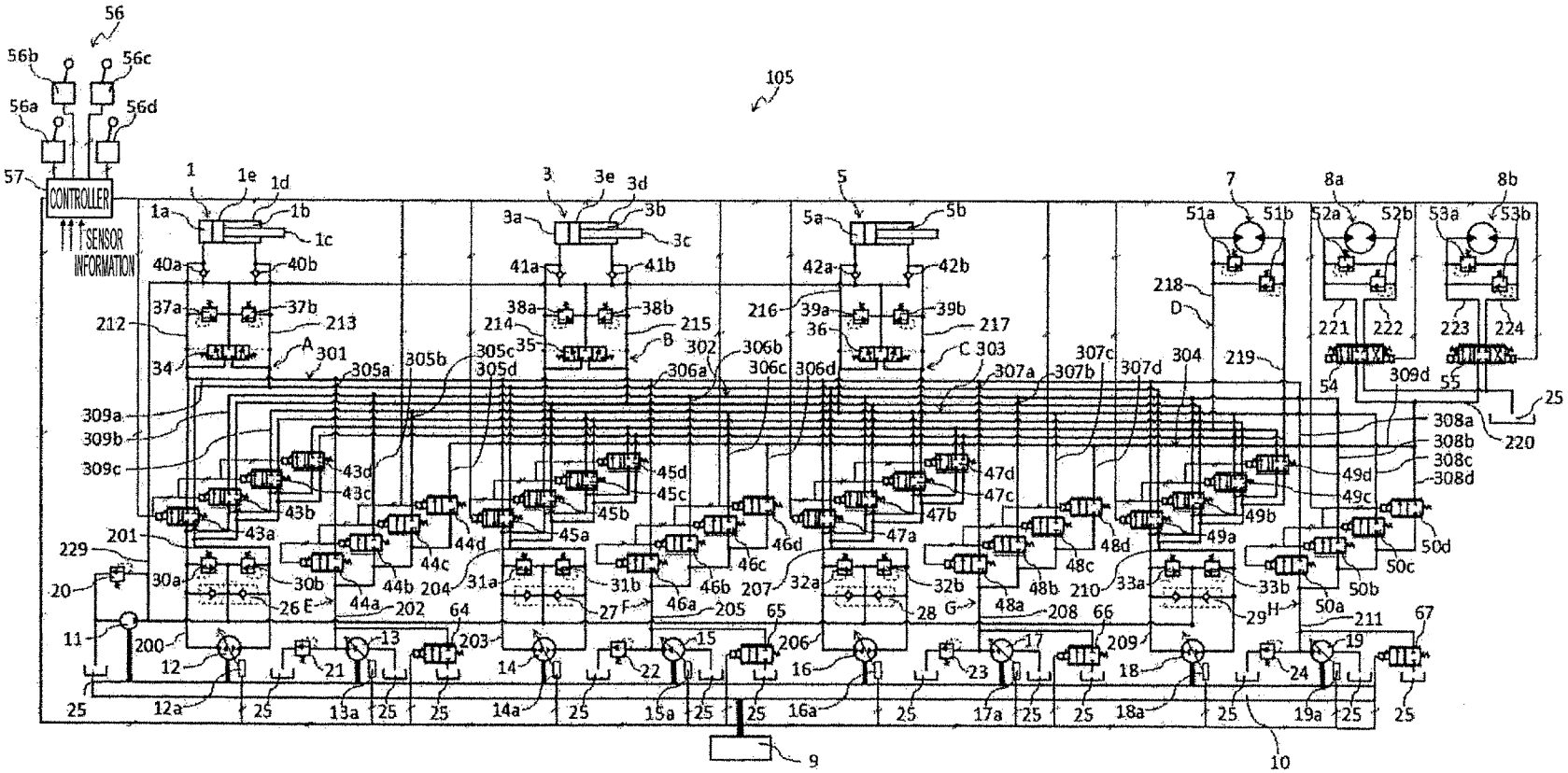
FIG. 2 is a schematic view showing the system construction of the driving device.

FIG. 1 is a schematic view showing a hydraulic excavator equipped with a driving device for a work machine according to a first embodiment of the present invention. FIG. 2 is a schematic view showing the system construction of the driving device. First of all, in the present first embodiment, four closed-circuit hydraulic pumps connected to closed circuits and four open-circuit hydraulic pumps connected to open circuits are provided for three kinds of single rod hydraulic cylinders and three kinds of hydraulic motors, and in driving a single rod hydraulic cylinder, flow rate control is carried out by the combination of one closed-circuit hydraulic pump and one open-circuit hydraulic pump. Further, there is taken a construction wherein these respective hydraulic pumps are provided with selector valves, so that a plurality of closed-circuit hydraulic pumps and a plurality of open-circuit hydraulic pumps can be brought into confluence for one single rod hydraulic cylinder. Furthermore, at the time of the confluence toward one single rod hydraulic cylinder, the selector valves are controlled by a controller to combine one closed-circuit hydraulic pump and one open-circuit hydraulic pump to be brought into confluence.

<Construction>

A hydraulic excavator 100 will be described as an example of a work machine which is equipped with a hydraulic drive system 105 shown in FIG. 2 according to the first embodiment of the present invention. As shown in FIG. 1, the hydraulic excavator 100 is provided with a lower traveling body 103 that is equipped with traveling devices 8*a*, 8*b* of the crawler type on both sides in a right-left direction, and an upper rotating body 102 as a machine body mounted rotatably on the lower traveling body 103. The upper rotating body 102 is provided thereon with a cab 101 into which an operator gets. The lower traveling body 103 and the upper rotating body 102 are attached rotatably through a swivel mechanism 7.

On its front side, the upper rotating body 3 pivotably attaches a base end portion of a front working assembly 104 being a working device for performing excavation works for example. Here, the front side means the direction in which an operator who gets in the cab 101 looks (the leftward direction in FIG. 1). The front working assembly 104 is provided with a boom 2 whose base end portion is coupled to the front side of the upper rotating body 102 to be pivotable in an upward-downward direction. The boom 2 is operated by the agency of a boom cylinder 1 being a single rod hydraulic cylinder that hydraulic oil (pressurized oil) as fluid supplied thereto drives. The boom cylinder 1 is coupled to the upper rotating body 102 at an extreme end of a rod 1*c* and is coupled to the boom 2 at a base end portion of a cylinder tube 1*d*.

Further, as shown in FIG. 2, the boom cylinder 1 is provided with a bottom chamber 1*a* being a first hydraulic oil chamber on a bottom side that is located on a base end side of the cylinder tube 1*d* and that, when supplied with hydraulic oil, presses a piston 1*e* attached to a base end portion of the rod 1*c* to give the same a load depending on the pressure of the hydraulic oil and thereby to move the rod 1*c* for extension. Further, the boom cylinder 1 is provided with a rod chamber 1*b* as a second hydraulic oil chamber on a rod side that is located on a distal end side of the cylinder tube 1*d* and that, when supplied with hydraulic oil, presses the piston 1*e* to give the same a load depending on the pressure of the hydraulic oil and thereby to move the rod 1*c* for contraction.

Further, a base end portion of an arm 4 is coupled with a distal end portion of the boom 2 pivotably in an upward-downward direction. The arm 4 is operated by the agency of an arm cylinder 3 being a single rod hydraulic cylinder. The arm cylinder 3 is coupled to the arm 4 at a distal end of a rod 3*c*, and a cylinder tube 3*d* of the arm cylinder 3 is coupled to the boom 2.

Further, as shown in FIG. 2, the arm cylinder 3 is provided with a bottom chamber 3*a* that is located on a base end side of the cylinder tube 3*d* and that, when supplied with hydraulic oil, presses a piston 3*e* attached to a base end portion of the rod 3*c* to move the rod 3*c* for extension. Further, the arm cylinder 3 is provided with a rod chamber 3*b* that is located on a distal end side of the cylinder tube 3*d* and that, when supplied with hydraulic oil, presses the piston 3*e* to move the rod 3*c* for contraction.

Further, a base end portion of a bucket 6 is coupled with a distal end portion of the arm 4 pivotably in an upward-downward direction. The bucket 6 is operated by the agency of a bucket cylinder 5 being a single rod hydraulic cylinder as a hydraulic actuator that is driven by hydraulic oil supplied. The bucket cylinder 5 is coupled with the bucket 6 at a distal end of a rod 5*c*, and a cylinder tube 5*d* of the bucket cylinder 5 is coupled to the arm 4 at a base end thereof.

Further, the bucket cylinder 5 is provided with a head chamber 5*a* that is located on the base end side of the cylinder tube 5*d* and that, when supplied with hydraulic oil, presses a piston 5*e* attached to a base end portion of the rod 5*c* to move the rod 75*c* for extension. Further, the bucket cylinder 5 is provided with a rod chamber 5*b* that is located on a distal end side of the cylinder tube 5*d* and that, when supplied with hydraulic oil, presses the piston 5*e* to move the rod 5*c* for contraction.

Each of the boom cylinder 1, the arm cylinder 3 and the bucket cylinder 5 is operated by hydraulic oil supplied thereto to be telescopically operated and is driven to be extended or contracted in dependence on the supply direction of the hydraulic oil supplied.

The hydraulic drive system 105 shown in FIG. 2 is mounted on the upper rotating body 102 of the hydraulic excavator 100 shown in FIG. 1 and is a drive system for driving the hydraulic excavator 100. The hydraulic drive system 105 is used for driving the swivel mechanism 7 and the traveling devices 8*a*, 8*b* in addition to the boom cylinder 1, the arm cylinder 3 and the bucket cylinder 5 that constitute the front working assembly 104. These swivel mechanism 7 and traveling devices 8*a*, 8*b* comprise hydraulic motors that are rotationally driven by being supplied with hydraulic oil.

Further, as shown in FIG. 2, the hydraulic drive system 105 drives the boom cylinder 1, the arm cylinder 3, the bucket cylinder 5, the swivel mechanism 7 and the traveling devices 8*a*, 8*b* that are hydraulic actuators, in accordance with the manipulation of a control lever device 56 as a control section installed in the cab 101. The extension and contraction movements of the boom cylinder 1, the arm cylinder 3 and the bucket cylinder 5, that is, the moving directions and moving speeds thereof are instructed by the operation directions and manipulated variables of respective control levers 56*a*, 56*b*, 56*c* and 56*d* of the control lever device 56.

Further, the hydraulic drive system 105 is provided with an engine 9 as a power source. The engine 9 is connected to a power transmission device 10 that is composed of, for example, predetermined gears for distributing a power. The power transmission device 10 is connected to first through eighth hydraulic pumps 12, 13, . . . , 19 being variable flow rate oil pumps and a charge pump 11 for replenishing pressurized oil to a passage 229 referred to later.

Then, the first through eighth hydraulic pumps 12, 13, . . . , 19 are each provided with a double-tilting swash plate mechanism (not shown) which has input/output ports as two or a pair of outflow/inflow ports enabling hydraulic oil to flow in and out in both directions, and a regulator 12*a*, 13*a*, . . . , 19*a* as a flow rate regulating section for adjusting the tilt angle (inclination angle) of a swash plate of the double-tilting type constituting the double-tilting swash plate mechanism. The regulator 12*a*, 13*a*, . . . , 19*a* is a flow rate control section that adjusts the tilt angle of the swash plate of a corresponding one of the first through eighth hydraulic pumps 12, 13, . . . , 19 in response to a control signal outputted from a controller 75 as a control section to control the flow rate of the hydraulic oil discharged from the first through eighth hydraulic pumps 12, 13, . . . , 19. Incidentally, the first through eighth hydraulic pumps 12, 13, . . . , 19 may each suffice to be of the variable tilting mechanism type such as an inclined shaft mechanism, but is not restricted to that of the swash plate mechanism type.

Therefore, the first through eighth hydraulic pumps 12, 13, . . . , 19 are each able to control the discharge flow rate and the discharge direction from the input/output ports by adjusting the tilt angle of the swash plate. Further, the first through eighth hydraulic pumps 12, 13, . . . , 19 each work as a hydraulic motor by being supplied with hydraulic oil. Of these, the first, third, fifth and seventh hydraulic pumps 12, 14, 16, 18 are closed-circuit hydraulic pumps that are used as closed-circuit hydraulic oil outflow/inflow control sections respectively connected to closed circuits A, B, C and D referred to later. Further, the second, fourth, sixth and eighth hydraulic pumps 13, 15, 17, 19 are open-circuit oil pumps as open-circuit hydraulic pumps that are used as open-circuit hydraulic oil outflow/inflow control sections respectively connected to open circuits E, F, G and H referred to later.

Specifically, the first hydraulic pump 12 is connected to a passage 200 at one input/output port thereof and is connected to a passage 201 at the other input/output port thereof. These passages 200, 201 are connected to plural, e.g., four selector valves 43*a*, 43*b*, 43*c*, 43*d*. The selector valves 43*a*, 43*b*, 43*c* are a closed-circuit switching control section for switching the supply of hydraulic oil to the boom cylinder 1, the arm cylinder 3 and the bucket cylinder 5 that are connected to the first hydraulic pump 12 in a closed-circuit fashion. Further, the selector valve 43*d* is a hydraulic motor closed-circuit switching control section for switching the supply of hydraulic oil to the swivel mechanism 7 that is connected to the first hydraulic pump 12 in a closed circuit fashion. Then, the selector valves 43*a*, 43*b*, 43*c*, 43*d* are each configured to switch the conduction and the cutoff of the passages 200, 201 in response to a control signal outputted from the controller 57 and are each held in cutoff state when no control signal is given from the controller 57. The controller 57 controls the selector valves 43*a*, 43*b*, 43*c*, 43*d* not to be brought into conduction states simultaneously.

Further, the selector valve 43*a* is connected to the boom cylinder 1 through passages 212 and 213. Thus, when the selector valve 43*a* is brought into the conduction state in response to a control signal outputted from the controller 57, the first hydraulic pump 12 constitutes the closed circuit A in which the pump 12 is connected in a closed-circuit fashion to the boom cylinder 1 through the passages 200, 201, the selector valve 43*a* and the passages 212, 213. Further, the selector valve 43*b* is connected to the arm cylinder 3 through passages 214 and 215. Thus, when the selector valve 43*b* is brought into the conduction state in response to a control signal outputted from the controller 57, the first hydraulic pump 12 constitutes the closed circuit B in which the pump 12 is connected in a closed-circuit fashion to the arm cylinder 3 through the passages 200, 201, the selector valve 43*b* and the passages 214, 215.

Further, the selector valve 43*c* is connected to the bucket cylinder 5 through passages 216 and 217. Thus, when the selector valve 43*c* is brought into the conduction state in response to a control signal outputted from the controller 57, the first hydraulic pump 12 constitutes the closed circuit C in which the pump 12 is connected in a closed-circuit fashion to the bucket cylinder 5 through the passages 200, 201, the selector valve 43*c* and the passages 216, 217. Further, the selector valve 43*d* is connected to the swivel mechanism 7 through passages 218 and 219. Thus, when the selector valve 43*d* is brought into the conduction state in response to a control signal outputted from the controller 57, the first hydraulic pump 12 constitutes the closed circuit D in which the pump 12 is connected in a closed-circuit fashion to the swivel mechanism 7 through the passages 200, 201, the selector valve 43*d* and the passages 218, 219.

Here, the passage 212 is a hydraulic cylinder connection passage for connecting the boom cylinder 1 independently to a plurality of selector valves 44*a*, 46*a*, 48*a* and 50*a* of the open circuits E, F, G and H referred to later. Further, the passage 214 is a hydraulic cylinder connection passage for connecting the arm cylinder 3 independently to a plurality of selector valves 44*b*, 46*b*, 48*b* and 50*b* of the open circuits E, F, G and H. Further, the passage 216 is a hydraulic cylinder connection passage for connecting the bucket cylinder 5 independently to a plurality of selector valves 44*c*, 46*c*, 48*c*, 50*c* of the open circuits E, F, G, H.

Further, the third hydraulic pump 14 is connected between passages 203 and 204, and plural, e.g., four selector valves 45*a*, 45*b*, 45*c* and 45*d* are connected between these passages 203 and 204. The third hydraulic pump 14, the passages 203, 204 and the selector valves 45*a*, 45*b*, 45*c* and 45*d* are configured in the same manner as the first hydraulic pump 12, the passages 200, 201 and the selector valves 44*a*, 44*b*, 44*c*, 44*d*.

After that, the fifth hydraulic pump 16 is connected between passages 206 and 207, and plural, e.g., four selector valves 47*a*, 47*b*, 47*c* and 47*d* are connected between these passages 206 and 207. The fifth hydraulic pump 16, the passages 206, 207 and the selector valves 47*a*, 47*b*, 47*c* and 47*d* are also configured in the same manner as the first hydraulic pump 12, the passages 200, 201 and the selector valves 44*a*, 44*b*, 44*c*, 44*d*.

Further, the seventh hydraulic pump 18 is connected between the passages 209 and 210, and plural, e.g., four selector valves 49*a*, 49*b*, 49*c* and 49*d* are connected between these passages 209 and 210. The seventh hydraulic pump 18, the passages 209, 210 and the selector valves 49*a*, 49*b*, 49*c*, 49*d* are also configured in the same manner as the first hydraulic pump 12, the passages 200, 201 and the selector valves 44*a*, 44*b*, 44*c*, 44*d*.

Further, one input/output port of the second hydraulic pump 13 is connected to plural, e.g., four selector valves 44*a*, 44*b*, 44*c* and 44*d* and a relief valve 21. The other input/output port of the second hydraulic pump 13 is connected to a tank 25 to make the open circuit E. The selector valves 44*a*, 44*b*, 44*c*, 44*d* are configured as an open circuit switching section that, in response to a control signal outputted from the controller 57, switches the passage 202 between conduction and cutoff to switch a supply destination of the hydraulic oil outflowing from the second hydraulic pump 13 to any of coupling passages 301, 302, 303 and 304, and are each held in the cutoff state when no control signal is given from the controller 57. The controller 57 controls the selector valves 44*a*, 44*b*, 44*c*, 44*d* not to be brought into conduction states simultaneously.

Further, the selector valve 44*a* is connected to the boom cylinder 1 through the coupling passage 301 and the passage 212. The coupling passage 301 is a connection passage provided to branch from the passage 212. Further, the selector valve 44*b* is connected to the arm cylinder 3 through the coupling passage 302 and the passage 214. The coupling passage 302 is a connection passage provided to branch from the passage 214. Further, the selector valve 44*c* is connected to the bucket cylinder 5 through the coupling passage 303 and the passage 216. The coupling passage 303 is a connection passage provided to branch from the passage 216. Further, the selector valve 44*d* is connected through the coupling passage 304 and the passage 220 to proportional selector valves 54 and 55 being control valves that control the supply and discharge of hydraulic oil to and from the traveling devices 8*a*, 8*b*. On the other hand, the relief valve 21 lets the hydraulic oil in the passage 202 go into the tank 25 to protect the passage 202 and hence, the hydraulic drive system 105 (hydraulic circuit) when the hydraulic oil in the passage 202 becomes a predetermined pressure or higher.

Further, between the passage 202 and the tank 25, there is connected a flow control valve 64 as a pressure-compensated flow rate adjusting valve. The flow control valve 64 is connected on a conduit branching from the passage 202 that connects the selector valves 44*a*, 44*b*, 44*c* and 44*d* to the second hydraulic pump 13, and leading to the tank 25. Thus, the flow control valve 64 controls the flow rate of hydraulic oil flowing from the passage 202 to the tank 25 in response to a control signal outputted from the controller 57. Further, the flow control valve 64 is held in the cutoff state when no control signal is given from the controller 57.

Further, one input/output port of the fourth hydraulic pump 15 is connected to plural, e.g., four selector valves 46*a*, 46*b*, 46*c* and 46*d* and a relief valve 22 through the passage 205. The other input/output port of the fourth hydraulic pump 15 is connected to the tank 25 to make the open circuit F. The selector valves 46*a*, 46*b*, 46*c*, 46*d* are configured in the same manner as the selector valves 44*a*, 44*b*, 44*c*, 44*d*.

Further, between the passage 205 and the tank 25, there is connected a flow control valve 65 as a pressure-compensated flow rate adjusting valve. The flow control valve 65 is configured in the same manner as the flow control valve 64 and is connected on a conduit branching from the passage 205 being a conduit that connects the selector valves 46*a*, 46*b*, 46*c* and 46*d* to the fourth hydraulic pump 15, and leading to the tank 25.

Further, one input/output port of the sixth hydraulic pump 17 is connected to plural, e.g., four selector valves 48*a*, 48*b*, 48*c* and 48*d* and a relief valve 23 through a passage 208. The other input/output port of the sixth hydraulic pump 17 is connected to the tank 25 to make the open circuit G. The selector valves 48*a*, 48*b*, 48*c*, 48*d* are also configured in the same manner as the selector valves 44*a*, 44*b*, 44*c*, 44*d*.

Further, between the passage 208 and the tank 25, there is connected a flow control valve 66 as a pressure-compensated flow rate adjusting valve. The flow control valve 65 is also configured in the same manner as the flow control valve 64 and is connected on a conduit branching from the passage 208 being a conduit that connects the selector valves 48*a*, 48*b*, 48*c*, 48*d* to the sixth hydraulic pump 17, and leading to the tank 25.

Further, one input/output port of the eighth hydraulic pump 19 is connected to plural, e.g., four selector valves 50*a*, 50*b*, 50*c* and 50*d* and a relief valve 24 through a passage 211. The other input/output port of the eighth hydraulic pump 19 is connected to the tank 25 to make the open circuit H. The selector valves 50*a*, 50*b*, 50*c*, 50*d* are also configured in the same manner as the selector valves 44*a*, 44*b*, 44*c*, 44*d*.

Further, between the passage 211 and the tank 25, there is connected a pressure-compensated flow control valve 67. The flow control valve 67 is also configured in the same manner as the flow control valve 64 and is connected on a conduit branching from the passage 211 being a conduit that connects the selector valves 50*a*, 50*b*, 50*c*, 50*d* to the eighth hydraulic pump 19, and leading to the tank 25. Accordingly, by controlling the second, fourth, sixth and eighth hydraulic pumps 13, 15, 17, 19 and the flow control valves 64, 65, 66, 67 by the controller 57, it is possible to more accurately control the flow rates of the hydraulic oils that outflow from the respective open circuits E, F, G, H to the predetermined single rod hydraulic cylinders, that is, the boom cylinder 1, the arm cylinder 3 and the bucket cylinder 5, and hence, these boom cylinder 1, arm cylinder 3 and bucket cylinder 5 can be further improved in operability.

The coupling passage 301 is composed of open-circuit connection passages 305*a*, 306*a*, 307*a* and 308*a* that are connected to discharge sides being the sides from which hydraulic oils outflow, of at least respective one selector valves 44*a*, 46*a*, 48*a*, 50*a* included in the plural open circuits E, F, G, H, and a closed-circuit connection passage 309*a* connected to the passage 212 constituting the closed circuit A. Likewise, the coupling passage 302 is composed of open-circuit connection passages 305*b*, 306*b*, 307*b* and 308*b* and a closed-circuit connection passage 309*b*. The coupling passage 303 is composed of open-circuit connection passages 305*c*, 306*c*, 307*c* and 308*c* and a closed-circuit connection passage 309*c*. The passage 304 is composed of open-circuit connection passages 305*d*, 306*d*, 307*d* and 308*d* and a closed-circuit connection passage 309*d*.

The hydraulic drive system 105 is composed of the closed circuits A, B, C and D in which the first, third, fifth and seventh hydraulic pumps 12, 14, 16, 18 and the boom cylinder 1, the arm cylinder 3, the bucket cylinder 5 and the swivel mechanism 7 are connected so that one input/output port of each hydraulic pump is connected through the hydraulic actuator to the other input/output port in a closed circuit fashion, and is further composed of the open circuits E, F, G and H in which the second, fourth, sixth and eighth hydraulic pumps 13, 15, 17, 19 and the selector valves 44*a*, 44*b*, 44*c*, 44*d*, 46*a*, 46*b*, 46*c*, 46*d*, 48*a*, 48*b*, 48*c*, 48*d*, 50*a*, 50*b*, 50*c*, 50*d* are connected so that each hydraulic pump is connected to each selector valve at one input/output port and is connected to the tank 25 at the other input/output port. Further, these closed circuits A, B, C, D and open circuits E, F, G, H are provided four by four, for example, and are provided to be paired respectively. Thus, the hydraulic oils that outflow from all of the open circuits E, F, G, H paired with the respective closed circuits A, B, C, D can be supplied to the desired single rod hydraulic cylinders, namely, to the boom cylinder 1, the arm cylinder 3 and the bucket cylinder 5. Accordingly, all of these plural closed circuits A, B, C, D are effectively utilized, so that the boom cylinder 1, the arm cylinder 3 and the bucket cylinder 5 can be improved in operability.

On the other hand, a discharge port of the charge pump 11 is connected to a charge relief valve 20, charge check valves 26, 27, 28, 29, 40*a*, 40*b*, 41*a*, 41*b*, 42*a*, 42*b*. A suction port of the charge pump 11 is connected to the tank 25. The charge relief valve 20 regulates a charge pressure acting on the charge check valves 26, 27, 28, 29, 40*a*, 40*b*, 41*a*, 41*b*, 42*a*, 42*b*.

Further, the charge check valves 26 supply the passages 200, 201 with hydraulic oil from the charge pump 11 when the hydraulic oil pressure in the passages 200, 201 falls below a pressure set by the charge relief valve 20. The charge check valves 27, 28, 29 are configured in the same manner as the charge check valves 26 and supply the passages 203, 204, 206, 207, 209, 210 with the hydraulic oil from the charge pump 11.

Further, the charge check valves 40*a*, 40*b*, 41*a*, 41*b*, 42*a*, 42*b* are also configured in the same manner as the charge check valves 26 and supply the passages 212, 213, 214, 215, 216, 217 with the hydraulic oil from the charge pump 11.

Further, between the passages 200 and 201, there are connected a pair of relief valves 30*a* and 30*b*. The relief valves 30*a*, 30*b* let the hydraulic oils in the passages 200, 201 go into the tank 25 through the charge relief valve 20 to protect the passages 200, 201 when the hydraulic oils in the passages 200, 201 become a predetermined pressure or higher. Likewise, a pair of relieve valves 31*a* and 31*b* are connected between the passages 203 and 204, a pair of relieve valves 32*a* and 32*b* are connected between the passages 206 and 207, and a pair of relieve valves 33*a* and 33*b* are connected between the passages 209 and 210. These relief valves 31*a*, 32*a*, 33*a* and 31*b*, 32*b*, 33*b* are configured in the same manner as the relief valves 30*a* and 30*b*.

After that, the passage 212 is connected to the bottom chamber 1*a* of the boom cylinder 1. The passage 213 is connected to the rod chamber 1*b* of the boom cylinder 1. Then, relief valves 37*a* and 37*b* are connected between the passages 212 and 213. The relief valves 37*a*, 37*b* let the hydraulic oils in the passages 212, 213 go into the tank 25 through the charge relief valve 20 to protect the passages 212, 213 when the hydraulic oils in the passages 212, 213 become a predetermined pressure or higher. Furthermore, a flushing valve 34 is connected between the passages 212 and 213. The flushing valve 34 drains those surplus of the hydraulic oils (surplus hydraulic oils) in the passages 212, 213 into the tank 25 through the charge relief valve 20.

Further, the passage 214 is connected to the head chamber 3*a* of the arm cylinder 3. The passage 215 is connected to the rod chamber 3*b* of the arm cylinder 3. Further, relief valves 38*a* and 38*b* are connected between the passages 214 and 215. The relief valves 38*a*, 38*b* are configured similarly to the relief valves 37*a*, 37*b* and protect the passages 214, 215. Furthermore, a flushing valve 35 is connected between the passages 214 and 215. The flushing valve 35 is configured similarly to the flushing valve 34 and drains those surplus of the hydraulic oils in the passages 214, 215.

Further, the passage 216 is connected to the head chamber 5*a* of the bucket cylinder 5. The passage 217 is connected to the rod chamber 5*b* of the bucket cylinder 5. Further, relief valves 39*a* and 39*b* are connected between the passages 216 and 217. The relief valves 39*a*, 39*b* are configured similarly to the relief valves 37*a*, 37*b* and protect the passages 216, 217. Furthermore, a flushing valve 36 is connected between the passages 216 and 217. The flushing valve 36 is configured similarly to the flushing valve 34 and drains those surplus of the hydraulic oils in the passages 216, 217.

Further, the passages 218 and 219 are connected to the swivel mechanism 7. Further, relief valves 51*a* and 51*b* are connected between the passages 218 and 219. The relief valves 51*a*, 51*b* let the hydraulic oil in the passage 218, 219 on a higher pressure side go to the passage 219, 218 on a lower pressure side to protect the passages 218, 219 when the difference in hydraulic oil pressure between the passages 218 and 219 (passage-to-passage pressure difference) exceeds a predetermined pressure.

Further, the proportional selector valve 54 and the traveling device 8*a* are connected through passages 221 and 222. Relief valves 52*a* and 52*b* are connected between the passages 221 and 222. The relief valves 52*a*, 52*b* are configured similarly to the relief valves 51*a*, 51*b* and protect the passages 221, 222. The proportional selector valve 54 is configured to alternately switch the connection destinations of the passage 220 and the tank 25 to the passages 221 and 222 in response to a control signal outputted from the controller 57 and is adjustable in flow rate.

Furthermore, the proportional selector valve 55 and the traveling device 8*b* are connected through passages 223 and 224. Relief valves 53*a* and 53*b* are connected between the passages 223 and 224. The relief valves 53*a*, 53*b* and the proportional selector valve 55 are configured similarly to the relief valves 52*a*, 52*b* and the proportional selector valve 54.

The controller 57 controls the respective regulators 12*a*, 13*a*, . . . , 19*a*, the selector valves 43*a*, 44*a*, . . . , 50*a*, 43*b*, 44*b*, . . . , 50*b*, 43*c*, 44*c*, . . . , 50*c*, 43*d*, 44*d*, . . . , 50*d* and the proportional selector valves 54, 55 based on command values that are from the control lever device 56 and that are indicative of extension/contraction directions and extension/contraction speeds of the boom cylinder 1, the arm cylinder 3 and the bucket cylinder 5, turn directions and turn speeds of the swivel mechanism 7 and the traveling devices 8*a*, 8*b*, and various sensor information given in the hydraulic drive system 105.

Specifically, the controller 57 performs a pressurized area ratio control that controls a first flow rate that is, for example, the flow rate of the first hydraulic pump 12 on the passage 212 side connected to the bottom chamber 1*a* and the rod chamber 1*b* of the boom cylinder 1, and a second flow rate that is the flow rate of the second hydraulic pump 13 connected to the coupling passage 301 through the selector valve 44*a*, so that the ratio of the first flow rate to the second flow rate becomes a predetermined value which is set beforehand in correspondence to the pressurized areas of the bottom chamber 1*a* and the rod chamber 1*b* of the boom cylinder 1. Likewise, the controller 57 performs the aforementioned pressurized area ratio control with respect to each of the arm cylinder 3 and the bucket cylinder 5 besides the boom cylinder 1. As a result, the first flow rates of the first, third and fifth hydraulic pumps 12, 14, 16 and the second flow rates of the second, fourth and sixth hydraulic pumps 13, 15, 17 are controlled by the controller 57 so that the ratios of the first flow rates to the second flow rates respectively become predetermined values that are set beforehand in correspondence to the pressurized areas of the respective bottom chamber 1*a* and head chambers 3*a*, 5*a* and rod chambers 1*b*, 3*b*, 5*b* of the boom cylinder 1, the arm cylinder 3 and the bucket cylinder 5, and hence, the operations of the boom cylinder 1, the arm cylinder 3 and the bucket cylinder 5 can be stabilized.

Further, when driving at least one of the boom cylinder 1, the arm cylinder 3 and the bucket cylinder 5, the controller 57 suitably controls the selector valves 43*a*, 44*a*, . . . , 50*a*, 43*b*, 44*b*, . . . , 50*b*, 43*c*, 44*c*, . . . , 50*c*, 43*d*, 44*d*, . . . , 50*d* to supply the at least one being driven of the boom cylinder 1, the arm cylinder 3 and the bucket cylinder 5 with the hydraulic oil discharged from the second, fourth, sixth and eighth hydraulic pumps 13, 15, 17, 19 being the same in number as the corresponding first, third, fifth and seventh hydraulic pumps 12, 14, 16, 18.

Further, the control lever 56*a* of the control lever device 56 gives the controller 57 command values indicative of the extension/contraction direction and the extension/contraction speed for the boom cylinder 1. The control lever 56*b* gives the controller 57 command values indicative of the extension/contraction direction and the extension/contraction speed for the arm cylinder 3, and the control lever 56*c* gives the controller 57 command values indicative of the extension/contraction direction and the extension/contraction speed for the bucket cylinder 5. Further, the control lever 56*d* gives the controller 57 command values indicative of the turn direction and the turn speed of the swivel mechanism 7. Incidentally, the control lever device 56 takes a construction that control levers (not shown) are also provided for giving the controller 57 command values indicative of the turn direction and the turn speed for the traveling devices 8*a*, 8*b*.

<Driving Method>

Next, regarding driving methods for the hydraulic drive system 105 according to the aforementioned first embodiment, with reference to FIG. 3, description will be made taking as examples those at an individual operation wherein the boom cylinder 1 is operated independently, and at a combined operation wherein in addition to the boom cylinder 1, the others, namely, the arm cylinder 3, the bucket cylinder 5 and the swivel mechanism 7 are operated in combination along with combined operations between the first through eighth hydraulic pumps 12, 13, . . . , 19 of the open circuits A, B, C, D and the closed circuits E, F, G, H. Incidentally, in the following description, it is assumed that the first, third, fifth and seventh hydraulic pumps 12, 14, 16, 18 connected to the closed circuits E, F, G, H are identical in displacement. Further, it is assumed that the boom cylinder 1, the arm cylinder 3 and the bucket cylinder 5 differ from one another in pressurized area ratio (the rod chamber pressurized area/the bottom (head) chamber pressurized area) and that there is a relation of the pressurized area ratio of the arm cylinder 3>the pressurized area ratio of the boom cylinder 1>the pressurized area ratio of the bucket cylinder 5.

Figure 3:
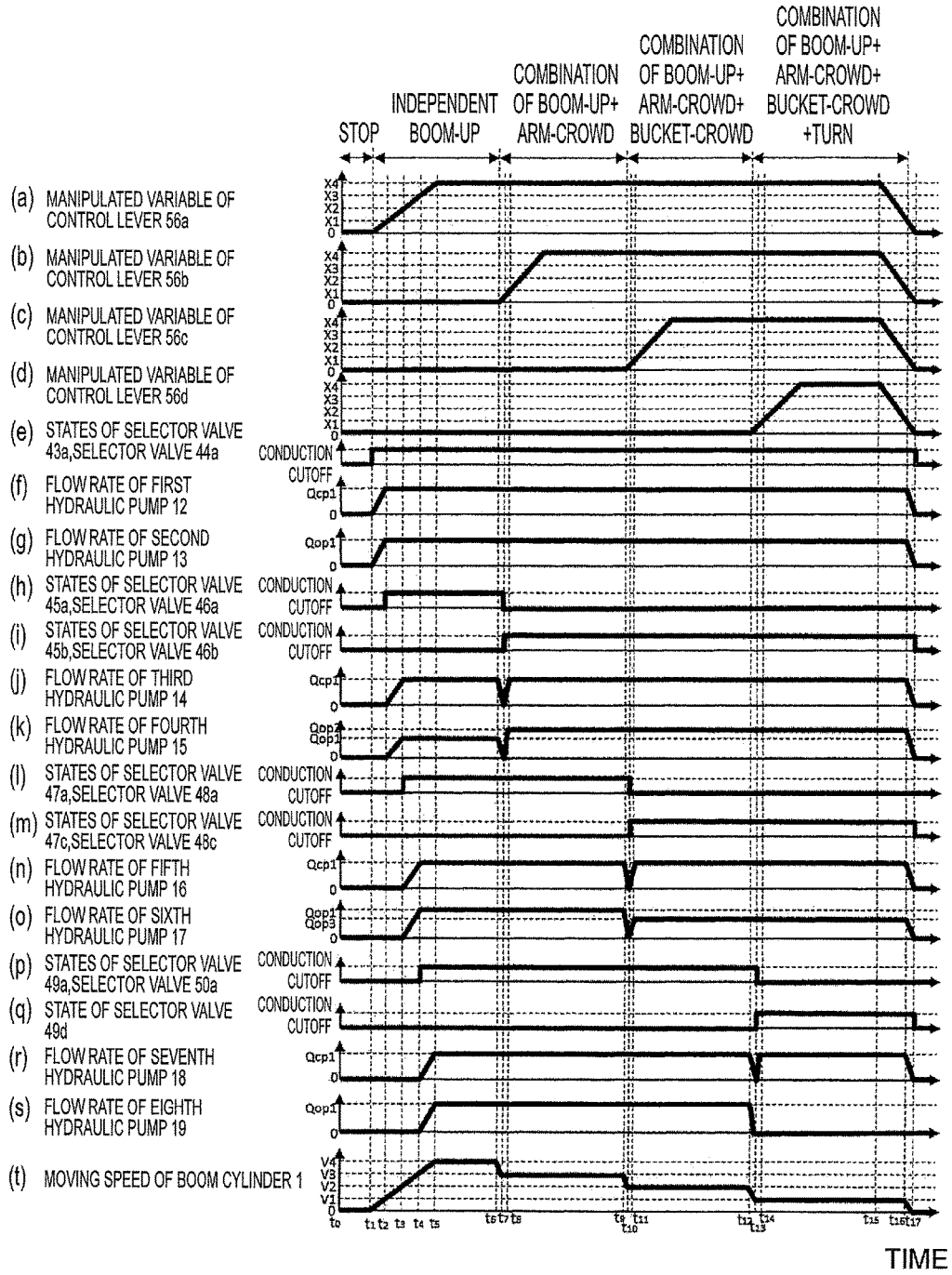
FIG. 3 is a time chart showing the state that the driving device is in a boom-up operation, wherein (a) denotes the manipulated variable of a control lever 56*a*, (b) denotes the manipulated variable of a control lever 56*b*, (c) denotes the manipulated variable of a control lever 56*c*, (d) denotes the manipulated variable of a control lever 56*d*, (e) denotes the states of selector valves 43*a* and 44*a*, (f) denotes the flow rate of a first hydraulic pump 12, (g) denotes the flow rate of a second hydraulic pump 13, (h) denotes the states of selector valves 45*a* and 46*a*, (i) denotes the states of selector valves 45*b* and 46*b*, (j) denotes the flow rate of a third hydraulic pump 14, (k) denotes the flow rate of a fourth hydraulic pump 15, (l) denotes the states of selector valves 47*a* and 48*a*, (m) denotes the states of selector valves 47*b* and 48*b*, (n) denotes the flow rate of a fifth hydraulic pump 16, (o) denotes the flow rate of a sixth hydraulic pump 17, (p) denotes the states of selector valves 49*a* and 50*a*, (q) denotes the state of a selector valve 49*d*, (r) denotes the flow rate of a seventh hydraulic pump 18, (s) denotes the flow rate of an eighth hydraulic pump 19, and (t) denotes the moving speed of a boom cylinder 1.

FIG. 3 is a time chart showing the state that the hydraulic drive system 105 is in a boom-up operation. Here, (a) denotes the manipulated variable of the control lever 56*a*, (b) denotes the manipulated variable of the control lever 56*b*, (c) denotes the manipulated variable of the control lever 56*c*, (d) denotes the manipulated variable of the control lever 56*d*, and (e) denotes the states of the selector valves 43*a* and 44*a*. (f) denotes the flow rate of the first hydraulic pump 12, (g) denotes the flow rate of the second hydraulic pump 13, (h) denotes the states of the selector valves 45*a* and 46*a*, (i) denotes the states of the selector valves 45*b* and 46*b*, and (j) denotes the flow rate of the third hydraulic pump 14. (k) denotes the flow rate of the fourth hydraulic pump 15, (l) denotes the states of the selector valves 47*a* and 48*a*, (m) denotes the states of the selector valves 47*b* and 48*b*, (n) denotes the flow rate of the fifth hydraulic pump 16, and (o) denotes the flow rate of the sixth hydraulic pump 17. (p) denotes the states of the selector valves 49*a* and 50*a*, (q) denotes the state of the selector valve 49*d*, (r) denotes the flow rate of the seventh hydraulic pump 18, (s) denotes the flow rate of the eighth hydraulic pump 19, and (t) denotes the moving speed of the boom cylinder 1.

(During Stop: t0-t1)

In FIG. 3, at an out-of-manipulation time (t0) when the respective control levers 56*a*, 56*b*, 56*c*, 56*d* of the control lever device 56 are not manipulated at all, the tilt angle of each swash plate of the first through eighth hydraulic pumps 12, 13, . . . , 19 is drivingly controlled to become the smallest tilt angle, so that these first through eighth hydraulic pumps 12, 13, . . . , 19 are held to make their discharge flow rates zero (0). At this time, all of the selector valves 43, 44, . . . , 50 and the proportional selector valves 54, 55 are controlled to remain in the cutoff state, so that the boom cylinder 1, the arm cylinder 3, the bucket cylinder 5, the swivel mechanism 7 and the traveling devices 8*a*, 8*b* are each held in a stop state.

(During Independent Boom-Up: t1-t6)

In FIG. 3, when a manipulation to instruct a boom-up is performed by the control lever 56*a* of the control lever device 56 (t1), the controller 57 controls the regulator 12*a* of the first hydraulic pump 12 to drive the swash plate of the first hydraulic pump 12 so that hydraulic oil is discharged from the first hydraulic pump 12 to the passage 200. At the same time, the controller 57 controls the regulator 13*a* of the second hydraulic pump 13 to drive the swash plate so that hydraulic oil is discharged from the second hydraulic pump 13 to the passage 202. At this time, the controller 57 brings the selector valves 43*a*, 44*a* into conduction control.

Then, when the operation value of the control lever 56*a* reaches X1 (t2), the discharge flow rate of the first hydraulic pump 12 becomes Qcp1, and the discharge flow rate of the second hydraulic pump 13 becomes Qop1. At this time, the controller 57 performs the aforementioned pressurized area ratio control, whereby the discharge flow rates (Qcp1, Qop1) of these first and second hydraulic pumps 12, 13 are determined so that the area ratio (Aa1:Aa2) of the pressurized area (Aa1) at the bottom chamber 1*a* to the pressurized area (Aa2) at the rod chamber 1*b* of the boom cylinder 1 becomes equal to the flow rate ratio {(Qcp1+Qop1):Qcp1} between the first and second hydraulic pumps 12, 13. Further, the controller 57 controls the discharge flow rates of the first and second hydraulic pumps 12, 13 so that the ratio of the discharge flow rate of the first hydraulic pump 12 to the discharge flow rate of the second hydraulic pump 13 is varied as the relation of Qcp1:Qop1 is maintained. At this time, when the operation value of the control lever 56*a* reaches X1 (t2), the moving speed of the boom cylinder 1 becomes V1.

Further, when the manipulated variable of the control lever 56*a* exceeds X1, the controller 57 controls the regulator 14*a* of the third hydraulic pump 14, and thus, the swash plate of the third hydraulic pump 14 is driven so that hydraulic oil is discharged from the third hydraulic pump 14 to the passage 203. At the same time, the controller 57 controls the regulator 15*a* of the fourth hydraulic pump 15, and thus, the swash plate thereof is driven so that hydraulic oil is discharged from the fourth hydraulic pump 15 to the passage 205. At this time, the controller 57 brings the selector valves 45*a*, 46*a* into conduction control.

Then, when the operation value of the control lever 56*a* reaches X2 (t3), the discharge flow rate of the third hydraulic pump 14 becomes Qcp1, and the discharge flow rate of the fourth hydraulic pump 15 becomes Qop1. Also at this time, the controller 57 performs the aforementioned pressurized area ratio control, whereby the discharge flow rates of these third and fourth hydraulic pumps 14, 15 are controlled so that the ratio of the discharge flow rate of the third hydraulic pump 14 to the discharge flow rate of the fourth hydraulic pump 15 is varied as the relation of Qcp1:Qop1 is maintained. At this time, when the manipulated variable of the control lever 56*a* reaches X2 (t3), the moving speed of the boom cylinder 1 becomes V2.

Further, when the manipulated variable of the control lever 56*a* exceeds X2, the controller 57 controls the regulator 16*a* of the fifth hydraulic pump 16, and thus, the swash plate of the fifth hydraulic pump 16 is driven so that hydraulic oil is discharged from the fifth hydraulic pump 16 to the passage 206. At the same time, the controller 57 controls the regulator 17*a* of the sixth hydraulic pump 17, and thus, the swash plate thereof is driven so that hydraulic oil is discharged from the sixth hydraulic pump 17 to the passage 208. At this time, the controller 57 brings the selector valves 47*a*, 48*a* into conduction control.

Then, when the manipulated variable of the control lever 56*a* reaches X3 (t4), the discharge flow rate of the fifth hydraulic pump 16 becomes Qcp1, and the discharge flow rate of the sixth hydraulic pump 17 becomes Qop1. Also at this time, the controller 57 performs the aforementioned pressurized area ratio control, whereby the discharge flow rates of these fifth and sixth hydraulic pumps 16, 17 are controlled so that the ratio of the discharge flow rate of the fifth hydraulic pump 16 to the discharge flow rate of the sixth hydraulic pump 17 is varied as the relation of Qcp1:Qop1 is maintained. At this time, when the manipulated variable of the control lever 56*a* reaches X3 (t4), the moving speed of the boom cylinder 1 becomes V3.

Further, when the manipulated variable of the control lever 56*a* exceeds X3, the controller 57 controls the regulator 18*a* of the seventh hydraulic pump 18, and thus, the swash plate of the seventh hydraulic pump 18 is driven so that hydraulic oil is discharged from the seventh hydraulic pump 18 to the passage 209. At the same time, the controller 57 controls the regulator 19*a* of the eighth hydraulic pump 19, and thus, the swash plate thereof is driven so that hydraulic oil is discharged from the eighth hydraulic pump 19 to the passage 211. At this time, the controller 57 brings the selector valves 49*a*, 50*a* into conduction control.

Then, when the manipulated variable of the control lever 56*a* reaches X4 (t5), the discharge flow rate of the seventh hydraulic pump 18 becomes Qcp1, and the discharge flow rate of the eighth hydraulic pump 19 becomes Qop1. Also at this time, the controller 57 performs the aforementioned pressurized area ratio control, whereby the discharge flow rates of these seventh and eighth hydraulic pumps 18, 19 are controlled so that the ratio of the discharge flow rate of the seventh hydraulic pump 18 to the discharge flow rate of the eighth hydraulic pump 19 is varied as the relation of Qcp1:Qop1 is maintained. At this time, when the manipulated variable of the control lever 56*a* reaches X4 (t5), the moving speed of the boom cylinder 1 becomes V4.

(During Combination of Boom-Up+Arm-Crowd: t6-t9)

In FIG. 3, when a manipulation to instruct an arm-crowd is performed by the control lever 56*b* (t6) in the state that the boom cylinder 1 is independently operating with the manipulated variable of the control lever 56*a* being X4, the controller 57 controls the regulator 14*a* of the third hydraulic pump 14, and thus, the swash plate of the third hydraulic pump 14 is driven so that the tilt angle thereof becomes the smallest tilt angle, and this makes discharge flow rate of the third hydraulic pump 14 zero (0). At the same time, the controller 57 controls the regulator 15*a* of the fourth hydraulic pump 15, and thus, the swash plate of the fourth hydraulic pump 15 is driven so that the tilt angle thereof becomes the smallest tilt angle, and this makes discharge flow rate of the fourth hydraulic pump 15 zero (0).

Thereafter, when the discharge flow rate of the third and fourth hydraulic pumps 14, 15 become zero (t7), the controller 57 brings the selector valves 45*a*, 46*a* into cutoff control and then, brings the selector valves 45*b*, 46*b* into conduction control. At the same time, the controller 57 controls the regulator 14*a* of the third hydraulic pump 14, and thus, the swash plate of the third hydraulic pump 14 is driven so that hydraulic oil is discharged from the third hydraulic pump 14 to the passage 203. The controller 57 also controls the regulator 15*a* of the fourth hydraulic pump 15, and thus, the swash plate thereof is driven so that hydraulic oil is discharged from the fourth hydraulic pump 15 to the passage 205.

Then, when the manipulated variable of the control lever 56*b* reaches X1 (t8), the discharge flow rate of the third hydraulic pump 14 becomes Qcp1, and the discharge flow rate of the fourth hydraulic pump 15 becomes Qop2 (>Qcp1). At this time, the controller 57 performs the aforementioned pressurized area ratio control, whereby the discharge flow rates (Qcp1, Qop2) of these third and fourth hydraulic pumps 14, 15 are determined so that the area ratio (Ab1:Ab2) of the area (Ab1) at the head chamber 3*a* to the area (Ab2) at the rod chamber 3*b* of the arm cylinder 3 becomes equal to the flow rate ratio {(Qcp1+Qop2):Qcp1} of the third and fourth hydraulic pumps 14, 15. Further, the controller 57 controls the discharge flow rates of these third and fourth hydraulic pumps 14, 15 so that the ratio of the discharge flow rate of the third hydraulic pump 14 to the discharge flow rate of the fourth hydraulic pump 15 is varied as the relation of Qcp1:Qop2 is maintained.

In sum, when the control lever 56*b* is manipulated, the hydraulic oil supplied to the boom cylinder 1 is decreased by the sum of the discharge flow rate (Qcp1) of the third hydraulic pump 14 and the discharge flow rate (Qop1) of the fourth hydraulic pump 15, and thus, the moving speed of the boom cylinder 1 becomes V3. Incidentally, when the manipulated variable of the control lever 56*b* is made to zero (0) in this state, return is made to the previous state (t5), and the moving speed of the boom cylinder 1 becomes V4 (not shown).

(During Combination of Boom-Up+Arm-Crowd+Bucket-Crowd: t9-t12)

In FIG. 3, when a manipulation to instruct a bucket-crowd is performed by the control lever 56*c* (t9) in the state that the boom cylinder 1 and the arm cylinder 3 are operating in combination with the manipulated variables of the control levers 56*a*, 56*b* being each X4, the controller 57 controls the regulator 16*a* of the fifth hydraulic pump 16, and thus, the swash plate of the fifth hydraulic pump 16 is driven so that the tilt angle thereof becomes the smallest tilt angle, and this makes discharge flow rate of the fifth hydraulic pump 16 zero (0). At the same time, the controller 57 controls the regulator 17*a* of the sixth hydraulic pump 17, and thus, the swash plate of the sixth hydraulic pump 17 is driven so that the tilt angle thereof becomes the smallest tilt angle, and this makes discharge flow rate of the sixth hydraulic pump 17 zero (0).

Thereafter, when the discharge flow rates of the fifth and sixth hydraulic pumps 16, 17 become zero (t10), the controller 57 brings the selector valves 47*a*, 48*a* into cutoff control and then, brings the selector valves 47*c*, 48*c* into conduction control. At the same time, the controller 57 controls the regulator 16*a* of the fifth hydraulic pump 16, and thus, the swash plate of the fifth hydraulic pump 16 is driven so that hydraulic oil is discharged from the fifth hydraulic pump 16 to the passage 206. The controller 57 also controls the regulator 17*a* of the sixth hydraulic pump 17, and thus, the swash plate thereof is driven so that hydraulic oil is discharged from the sixth hydraulic pump 17 to the passage 208.

Then, when the manipulated variable of the control lever 56*c* reaches X1 (t11), the discharge flow rate of the fifth hydraulic pump 16 becomes Qcp1, and the discharge flow rate of the sixth hydraulic pump 17 becomes Qop3 (<Qop1). At this time, the controller 57 performs the aforementioned pressurized area ratio control, whereby the discharge flow rates (Qcp1, Qop3) of these fifth and sixth hydraulic pumps 16, 17 are determined so that the area ratio (Ac1:Ac2) of the area (Ac1) at the head chamber 5*a* to the area (Ac2) at the rod chamber 3*b* of the bucket cylinder 5 becomes equal to the flow rate ratio {(Qcp1+Qop3):Qop3} of the fifth and sixth hydraulic pumps 16, 17. Further, the controller 57 controls the discharge flow rates of these fifth and sixth hydraulic pumps 16, 17 so that the ratio of the discharge flow rate of the fifth hydraulic pump 16 to the discharge flow rate of the sixth hydraulic pump 17 is varied as the relation of Qcp1:Qop3 is maintained.

In sum, when the control lever 56*c* is manipulated, the hydraulic oil supplied to the boom cylinder 1 is decreased by the sum of the discharge flow rate Qcp1 of the fifth hydraulic pump 16 and the discharge flow rate Qop1 of the sixth hydraulic pump 17, and thus, the moving speed of the boom cylinder 1 becomes V2. Incidentally, when the manipulated variable of the control lever 56*c* is made to zero (0) in this state, return is made to the previous state (t8), and the moving speed of the boom cylinder 1 becomes V3 (not shown).

(During Combination of Boom-Up+Arm-Crowd+Bucket-Crowd+Turn: t12-t16)

In FIG. 3, when a manipulation to instruct a turn to either right or left is performed by the control lever 56*d* (t12) in the state that the boom cylinder 1, the arm cylinder 3 and the bucket cylinder 5 are operating in combination with the manipulated variables of the control levers 56*a*, 56*b*, 56*fc* being each X4, the controller 57 controls the regulator 18*a* of the seventh hydraulic pump 18, and thus, the swash plate of the seventh hydraulic pump 18 is driven so that the tilt angle thereof becomes the smallest tilt angle, and this makes discharge flow rate of the seventh hydraulic pump 18 zero (0). At the same time, the controller 57 controls the regulator 19*a* of the eighth hydraulic pump 19, and thus, the swash plate of the eighth hydraulic pump 19 is driven so that the tilt angle thereof becomes the smallest tilt angle, and this makes discharge flow rate of the eighth hydraulic pump 19 zero (0).

Thereafter, when the discharge flow rate of the seventh and eighth hydraulic pumps 18, 19 become zero (t13), the controller 57 brings the selector valves 49*a*, 50*a* into cutoff control and then, brings the selector valve 49*d* into conduction control. At the same time, the controller 57 controls the regulator 18*a* of the seventh hydraulic pump 18, and thus, the swash plate of the seventh hydraulic pump 18 is driven so that hydraulic oil is discharged from the seventh hydraulic pump 18 to the passage 209.

Then, when the manipulated variable of the control lever 56*d* reaches X1 (t14), the discharge flow rate of the seventh hydraulic pump 18 becomes Qcp1. That is, when the control lever 56*d* is manipulated, the hydraulic oil supplied to the boom cylinder 1 is decreased by the sum of the discharge flow rate (Qcp1) of the seventh hydraulic pump 18 and the discharge flow rate (Qop1) of the eighth hydraulic pump 19, and thus, the moving speed of the boom cylinder 1 becomes V1. Incidentally, when the manipulated variable of the control lever 56*d* is made to zero (0) in this state, return is made to the previous state (t11), and the moving speed of the boom cylinder 1 becomes V2 (not shown).

Further, when command values indicative of a rotational direction and a rotational speed for the traveling devices 8*a*, 8*b* are inputted from the control lever device 56 to the controller 57, the controller 57 brings the selector valve 50*d* into conduction control and controls the regulator 19*a* of the eighth hydraulic pump 19 to drive the swash plate of the eighth hydraulic pump 19. Further, in response to the command values inputted from the control lever device 56, the controller 57 adjusts throttle amounts of the proportional control valves 54, 55, so that the rotational direction and the rotational speed of the traveling devices 8*a*, 8*b* are controlled.

Thereafter, when the manipulated variables of the respective control levers 56*a*, 56*b*, 56*c*, 56*d* are returned from the state of being X4 (t15) to the state of being zero (t16), the controller 57 controls the regulators 12*a*, 13*a*, . . . , 18*a* of the first through seventh hydraulic pumps 12, 13, . . . , 18, and thus, the discharge flow rates of these first through seventh hydraulic pumps 12, 13, . . . , 18 are made to zero. At the same time, the controller 75 brings the respective selector valves 43*a*, 44*a*, 45*b*, 46*b*, 47*c*, 48*c*, 49*d* into cutoff control, so that driving is discontinued in the boom cylinder 1, the arm cylinder 3, the bucket cylinder 5 and the swivel mechanism 7 (t17).

Figure 4:
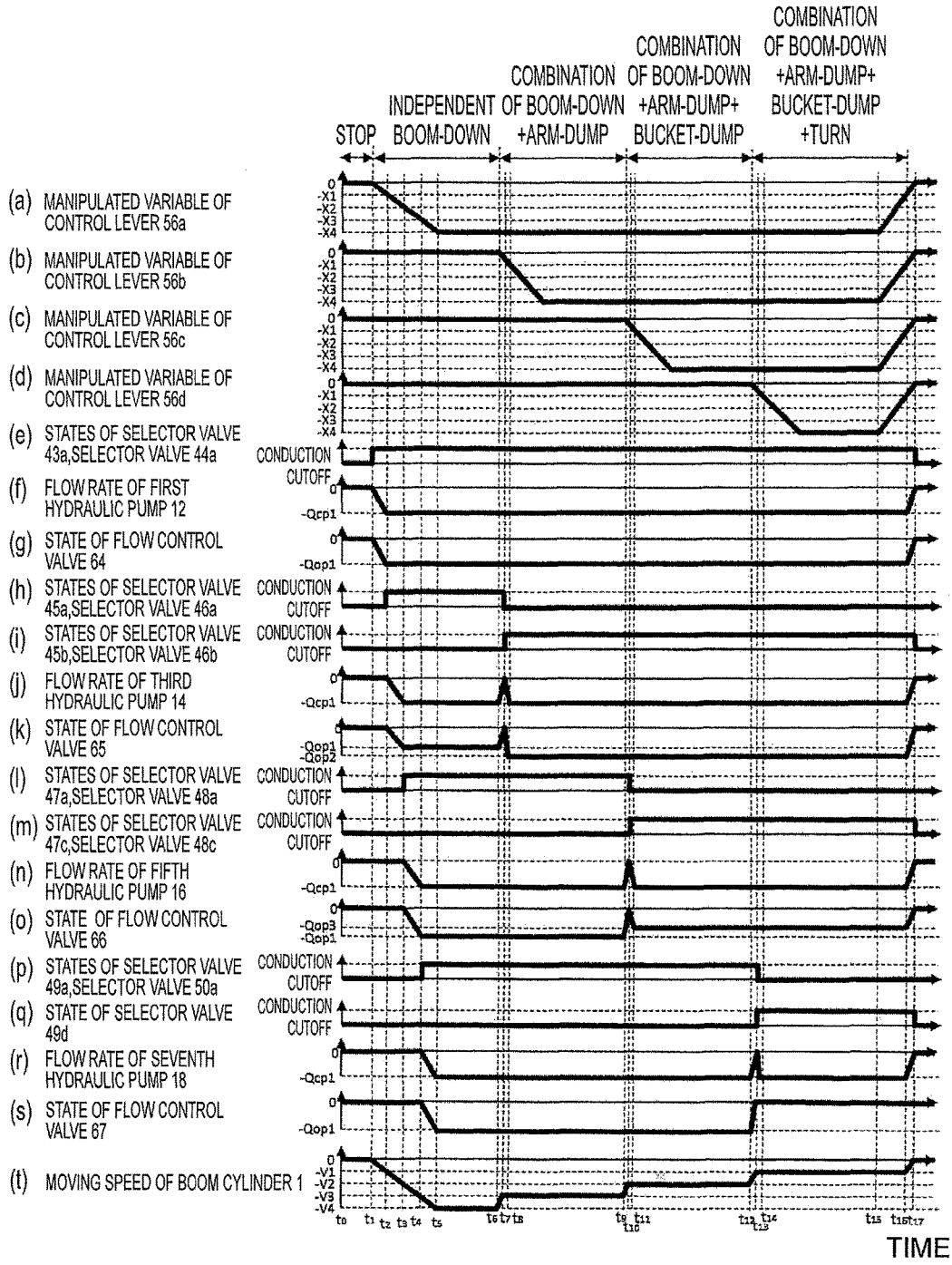
FIG. 4 is a time chart showing the state that the driving device is in a boom-down operation, wherein (a) denotes the manipulated variable of the control lever 56*a*, (b) denotes the manipulated variable of the control lever 56*b*, (c) denotes the manipulated variable of the control lever 56*c*, (d) denotes the manipulated variable of the control lever 56*d*, (e) denotes the states of the selector valves 43*a* and 44*a*, (f) denotes the flow rate of the first hydraulic pump 12, (g) denotes the state of a flow control valve 64, (h) denotes the states of the selector valves 45*b* and 46*b*, (i) denotes the states of the selector valves 45*b* and 46*b*, (j) denotes the flow rate of the third hydraulic pump 14, (k) denotes the state of a flow control valve 65, (l) denotes the states of the selector valves 47*a* and 48*a*, (m) denotes the states of the selector valves 47*b* and 48*b*, (n) denotes the flow rate of the fifth hydraulic pump 16, (o) denotes the state of a flow control valve 66, (p) denotes the states of the selector valves 49*a* and 50*a*, (q) denotes the state of the selector valve 49*d*, (r) denotes the flow rate of the seventh hydraulic pump 18, (s) denotes the state of a flow control valve 67, and (t) denotes the moving speed of the boom cylinder 1.

FIG. 4 is a time chart showing the state that the hydraulic drive system 105 is in the boom-down operation. Here, (a) denotes the manipulated variable of the control lever 56*a*, (b) denotes the manipulated variable of the control lever 56*b*, (c) denotes the manipulated variable of the control lever 56*c*, (d) denotes the manipulated variable of the control lever 56*d*, and (e) denotes the states of the selector valves 43*a* and 44*a*. (f) denotes the flow rate of the first hydraulic pump 12, (g) denotes the state of the flow control valve 64, (h) denotes the states of the selector valves 45*a* and 46*a*, (i) denotes the states of the selector valves 45*b* and 46*b*, (j) denotes the flow rate of the third hydraulic pump 14. (k) denotes the state of the flow control valve 65, (l) denotes the states of the selector valves 47*a* and 48*a*, (m) denotes the states of the selector valves 47*b* and 48*b*, (n) denotes the flow rate of the fifth hydraulic pump 16, and (o) denotes the state of the flow control valve 66. (p) denotes the states of the selector valves 49*a* and 50*a*, (q) denotes the state of the selector valve 49*d*, (r) denotes the flow rate of the seventh hydraulic pump 18, (s) denotes the state of a flow control valve 67, and (t) denotes the moving speed of the boom cylinder 1.

(During Independent Boom-Down: t1-t6)

In FIG. 4, when a manipulation to instruct a boom-down is performed by the control lever 56*a*(t1), the controller 57 controls the regulator 12*a* of the first hydraulic pump 12, and thus, the swash plate of the first hydraulic pump 12 is driven so that hydraulic oil is discharged from the first hydraulic pump 12 to the passage 201. At the same time, the controller 57 gives the flow control valve 64 a flow rate command. At this time, the controller 57 brings the selector valves 43*a*, 44*a* into conduction control.

Then, when the manipulated variable of the control lever 56*a* reaches −X1 (t2), the discharge flow rate of the first hydraulic pump 12 becomes −Qcp1, and the flow rate that is drained from the flow control valve 64 to the tank 25, that is, the drain flow rate becomes −Qop1. At this time, the controller 57 performs the aforementioned pressurized area ratio control, whereby the discharge flow rate of the first hydraulic pump 12 and the drain flow rate of the flow control valve 64 (Qcp1, Qop1) are determined so that the area ratio (Aa1:Aa2) of the area (Aa1) at the bottom chamber 1*a* to the area (Aa2) at the rod chamber 1*b* of the boom cylinder 1 becomes equal to the flow rate ratio {(Qcp1+Qop1):Qcp1} between the first hydraulic pump 12 and the flow control valve 64. Further, the controller 57 controls the discharge flow rate of the first hydraulic pump 12 and the drain flow rate of the flow control valve 64 so that the ratio of the discharge flow rate of the first hydraulic pump 12 to the drain flow rate of the flow control valve 64 is varied as the relation of Qcp1:Qop1 is maintained. At this time, when the manipulated variable of the control lever 56*a* reaches −X1 (t2), the moving speed of the boom cylinder 1 becomes −V1.

Further, when the manipulated variable of the control lever 56*a* exceeds −X1, the controller 57 controls the regulator 14*a* of the third hydraulic pump 14, and thus, the swash plate of the third hydraulic pump 14 is driven so that hydraulic oil is discharged from the third hydraulic pump 14 to the passage 204. At the same time, the controller 57 gives the flow control valve 65 a flow rate command. At this time, the controller 57 brings the selector valves 45*a*, 46*a* into conduction control.

Then, when the manipulated variable of the control lever 56*a* reaches −X2 (t3), the discharge flow rate of the third hydraulic pump 14 becomes −Qcp1, and the flow rate drained from the flow control valve 65 to the tank 25, that is, the drain flow rate becomes −Qop1. Further, the controller 57 performs the aforementioned pressurized area ratio control, whereby the discharge flow rate of the third hydraulic pump 14 and the drain flow rate of the flow control valve 65 are controlled so that the ratio of the discharge flow rate of the third hydraulic pump 14 to the drain flow rate of the flow control valve 65 is varied as the relation of Qcp1:Qop1 is maintained. At this time, when the manipulated variable of the control lever 56*a* reaches −X2 (t3), the moving speed of the boom cylinder 1 becomes −V2.

Further, when the manipulated variable of the control lever 56*a* exceeds −X2, the controller 57 controls the regulator 16*a* of the fifth hydraulic pump 16, and thus, the swash plate of the fifth hydraulic pump 16 is driven so that hydraulic oil is discharged from the fifth hydraulic pump 16 to the passage 207. At the same time, the controller 57 gives the flow control valve 66 a flow rate command. At this time, the controller 57 brings the selector valves 47*a*, 48*a* into conduction control.

Then, when the manipulated variable of the control lever 56*a* reaches −X3 (t4), the discharge flow rate of the fifth hydraulic pump 16 becomes −Qcp1, and the flow rate drained from the flow control valve 66 to the tank 25, that is, the drain flow rate becomes −Qop1. Further, the controller 57 performs the aforementioned pressurized area ratio control, whereby the discharge flow rate of the fifth hydraulic pump 16 and the drain flow rate of the flow control valve 66 are controlled so that the ratio of the discharge flow rate of the fifth hydraulic pump 16 to the drain flow rate of the flow control valve 66 is varied as the relation of Qcp1:Qop1 is maintained. At this time, when the manipulated variable of the control lever 56*a* reaches −X3 (t4), the moving speed of the boom cylinder 1 becomes −V3.

Further, when the manipulated variable of the control lever 56*a* exceeds −X3, the controller 57 controls the regulator 18*a* of the seventh hydraulic pump 18, and thus, the swash plate of the seventh hydraulic pump 18 is driven so that hydraulic oil is discharged from the seventh hydraulic pump 18 to the passage 210. At the same time, the controller 57 gives the flow control valve 67 a flow rate command. At this time, the controller 57 brings the selector valves 49*a*, 50*a* into conduction control.

Then, when the manipulated variable of the control lever 56*a* reaches −X4 (t5), the discharge flow rate of the seventh hydraulic pump 18 becomes −Qcp1, and the flow rate drained from the flow control valve 67 to the tank 25, that is, the drain flow rate becomes −Qop1. Further, the controller 57 performs the aforementioned pressurized area ratio control, whereby the discharge flow rate of the eighth hydraulic pump 19 and the drain flow rate of the flow control valve 67 are controlled so that the ratio of the discharge flow rate of the seventh hydraulic pump 18 to the drain flow rate of the flow control valve 67 is varied as the relation of Qcp1:Qop1 is maintained. At this time, when the manipulated variable of the control lever 56*a* reaches −X4 (t5), the moving speed of the boom cylinder 1 becomes −V4.

(During Combination of Boom-Down+Arm-Dump: t6-t9)

In FIG. 4, when a manipulation to instruct an arm-dump is performed by the control lever 56*b* (t6) in the state that the boom cylinder 1 is independently operating with the manipulated variable of the control lever 56*a* being −X4, the controller 57 controls the regulator 14*a* of the third hydraulic pump 14, and thus, the swash plate of the third hydraulic pump 14 is driven so that the tilt angle thereof becomes the smallest tilt angle, and this makes discharge flow rate of the third hydraulic pump 14 zero (0). At the same time, the controller 57 controls the flow control value 65, and this makes the drain flow rate of the flow control value 65 zero (0).

Thereafter, when the discharge flow rate of the third hydraulic pump 14 and the drain flow rate of the flow control valve 65 become zero (t7), the controller 57 brings the selector valves 45*a*, 46*a* into cutoff control and then, brings the selector valves 45*b*, 46*b* into conduction control. At the same time, the controller 57 controls the regulator 14*a* of the third hydraulic pump 14, and thus, the swash plate of the third hydraulic pump 14 is driven so that hydraulic oil is discharged from the third hydraulic pump 14 to the passage 204. The controller 57 also gives the flow control valve 65 a flow rate command.

Then, when the manipulated variable of the control lever 56*b* reaches −X1 (t8), the discharge flow rate of the third hydraulic pump 14 becomes −Qcp1, and the flow rate drained from the flow control valve 65 to the tank 25, that is, the drain flow rate becomes −Qop2 (<−Qop1). At this time, the controller 57 performs the aforementioned pressurized area ratio control, whereby the discharge flow rate of the third hydraulic pump 14 and the drain flow rate of the flow control valve 65 (−Qcp1, −Qop2) are determined so that the area ratio (Ab1:Ab2) of the area (Ab1) at the head chamber 3*a* to the area (Ab2) at the rod chamber 3*b* of the arm cylinder 3 becomes equal to the flow rate ratio {(Qcp1+Qop2):Qcp1} of the third hydraulic pump 14 and the flow control valve 65. Further, the controller 57 controls the discharge flow rate of the third hydraulic pump 14 and the drain flow rate of the flow control valve 65 so that the ratio of the discharge flow rate of the third hydraulic pump 14 to the drain flow rate of the flow control valve 65 is varied as the relation of Qcp1:Qop2 is maintained.

In sum, when the control lever 56*b* is manipulated, the hydraulic oil supplied to the boom cylinder 1 is decreased by the sum of the discharge flow rate (−Qcp1) of the third hydraulic pump 14 and the drain flow rate (−Qoc1) of the flow control valve 65, and thus, the moving speed of the boom cylinder 1 becomes −V3. Incidentally, when the manipulated variable of the control lever 56*b* is made to zero (0) in this state, return is made to the previous state (t5), and the moving speed of the boom cylinder 1 becomes −V4.

(During Combination of Boom-Down+Arm-Dump+Bucket-Dump: t9-t12)

In FIG. 4, when a manipulation to instruct the bucket-dump is performed by the control lever 56*c* (t9) in the state that the boom cylinder 1 and the arm cylinder 3 are operating in combination with the manipulated variables of the control levers 56*a*, 56*b* being each −X4, the controller 57 controls the regulator 16*a* of the fifth hydraulic pump 16, and thus, the swash plate of the fifth hydraulic pump 16 is driven so that the tilt angle thereof becomes the smallest tilt angle, and this makes discharge flow rate of the fifth hydraulic pump 16 zero (0). At the same time, the controller 57 controls the flow control valve 66, and this makes the drain flow rate of the flow control valve 66 zero (0).

Thereafter, when the discharge flow rate of the fifth hydraulic pump 16 and the drain flow rate of the flow control valve 66 become zero (t10), the controller 57 brings the selector valves 47*a*, 48*a* into cutoff control and then, brings the selector valves 47*c*, 48*c* into conduction control. At the same time, the controller 57 controls the regulator 16*a* of the fifth hydraulic pump 16, and thus, the swash plate of the fifth hydraulic pump 17 is driven so that hydraulic oil is discharged from the fifth hydraulic pump 16 to the passage 207. The controller 57 also gives the flow control valve 66 a flow rate command.

Then, when the manipulated variable of the control lever 56*c* reaches −X1 (t11), the discharge flow rate of the fifth hydraulic pump 16 becomes −Qcp1, and the flow rate drained from the flow control valve 66 to the tank 25, that is, the drain flow rate becomes −Qop3 (>−Qop1). At this time, the controller 57 performs the aforementioned pressurized area ratio control, whereby the discharge flow rate of the fifth hydraulic pump 16 and the drain flow rate of the flow control valve 66 (−Qcp1, −Qop3) are determined so that the area ratio (Ac1:Ac2) of the area (Ac1) at the head chamber 5*a* to the area (Ac2) at the rod chamber 5*b* of the bucket cylinder 5 becomes equal to the flow rate ratio {(Qcp1+Qop3):Qcp1} of the fifth hydraulic pump 16 and the flow control valve 66. Further, the controller 57 controls the discharge flow rates of the fifth hydraulic pump 16 and the drain flow rate of the flow control valve 66 so that the ratio of the discharge flow rate of the fifth hydraulic pump 16 to the drain flow rate of the flow control valve 66 is varied as the relation of Qcp1:Qop3 is maintained.

In sum, when the control lever 56*c* is manipulated, the hydraulic oil supplied to the boom cylinder 1 is decreased by the sum of the discharge flow rate (Qcp1) of the fifth hydraulic pump 16 and the drain flow rate (Qop1) of the flow control valve 66, and thus, the moving speed of the boom cylinder 1 becomes −V2. Incidentally, when the manipulated variable of the control lever 56*c* is made to zero (0) in this state, return is made to the previous state (t8), and the moving speed of the boom cylinder 1 becomes −V3 (not shown).

(During Combination of Boom-Down+Arm-Dump+Bucket-Dump+Turn: t12-t16)

In FIG. 4, when a manipulation to instruct a turn to either right or left is performed by the control lever 56*d* (t12) in the state that the boom cylinder 1, the arm cylinder 3 and the bucket cylinder 5 are operating in combination with the manipulated variables of the control levers 56*a*, 56*b*, 56*fc* being each −X4, the controller 57 controls the regulator 18*a* of the seventh hydraulic pump 18, and thus, the swash plate of the seventh hydraulic pump 18 is driven so that the tilt angle thereof become the smallest tilt angle, and this makes discharge flow rate of the seventh hydraulic pump 18 zero (0). At the same time, the controller 57 controls the flow control valve 67, and this makes the drain flow rate of the flow control valve 67 zero (0).

Thereafter, when the discharge flow rate of the seventh hydraulic pump 18 and the drain flow rate of the flow control valve 67 become zero (t13), the controller 57 brings the selector valves 49*a*, 50*a* into cutoff control and then, brings the selector valve 49*d* into conduction control. At the same time, the controller 57 controls the regulator 18*a* of the seventh hydraulic pump 18, and thus, the swash plate of the seventh hydraulic pump 18 is driven so that discharge is performed from the seventh hydraulic pump 18 to the passage 210.

Then, when the manipulated variable of the control lever 56*d* reaches −X1 (t14), the discharge flow rate of the seventh hydraulic pump 18 becomes −Qcp1. That is, when the control lever 56*d* is manipulated, the hydraulic oil supplied to the boom cylinder 1 is decreased by the sum of the discharge flow rate (−Qcp1) of the seventh hydraulic pump 18 and the drain flow rate (−Qop1) of the flow control valve 67, and thus, the moving speed of the boom cylinder 1 becomes −V1. Incidentally, when the manipulated variable of the control lever 56*d* is made to zero (0) in this state, return is made to the previous state (t11), and the moving speed of the boom cylinder 1 becomes −V2 (not shown).

Thereafter, when the manipulated variables of the respective control levers 56*a*, 56*b*, 56*c*, 56*d* are returned from the state of being −X4 (t15) to the state of being zero (t16), the controller 57 controls the regulators 12*a*, 14*a*, 16*a*, 18*a* of the first, third, fifth and seventh hydraulic pumps 12, 14, 16, 18 and the flow control valves 64, 65, 66, so that the discharge flow rates of these first, third, fifth, and seventh hydraulic pumps 12, 14, 16, 18 and the drain flow rates of the flow control valves 64, 65, 66 are made to zero. At the same time, the controller 57 brings the respective selector valves 43*a*, 44*a*, 45*b*, 46*b*, 47*c*, 48*c*, 49*d* into cutoff control, so that driving is discontinued in the boom cylinder 1, the arm cylinder 3, the bucket cylinder 5 and the swivel mechanism 7 (t17).

<Advantageous Effects>

In the aforementioned Patent Literature 1, there is taken a construction provided with a plurality of closed circuits (first and second closed circuits) each connecting a single rod hydraulic cylinder and a hydraulic pump in a closed circuit fashion, one open circuit connecting a reservoir to an input port of a hydraulic pump wherein a control valve connected to an output port of the hydraulic pump controls the single rod hydraulic cylinder, and a distribution circuit that distributes hydraulic oil from the one open circuit to the plural closed circuits. Thus, in the hydraulic circuit according to this patent literature, when the plural single rod hydraulic cylinders are operated simultaneously, the load acting on the individual single rod hydraulic cylinder fluctuates, and this fluctuation causes the closed circuits to fluctuate in pressure, so that fluctuation in pressure occurs in the open circuit that distributes the flow rate of hydraulic oil to the closed circuits.

Particularly, even where the flow rate of the hydraulic oil supplied from the hydraulic pump of the open circuit is fixed, the fluctuation of the hydraulic oil pressure in the open circuit causes the hydraulic oil supplied to the closed circuits to fluctuate in flow rate, so that a change in ratio takes place between the flow rate of the hydraulic pump in the closed circuit different from that fluctuating in load and the flow rate flowing from the open circuit. As a result, since the hydraulic oil flowing to the single rod hydraulic cylinders becomes unstable in flow rate, there may arise an anxiety that the hydraulic excavator is, as a whole, degraded in maneuverability.

Therefore, in the hydraulic drive system 105 according to the foregoing first embodiment of the present invention, as shown in FIG. 2, construction is taken to make the first, third and fifth hydraulic pumps 12, 14, 16 connectable to each of the boom cylinder 1, the arm cylinder 3 and the bucket cylinder 5 in the closed-circuit fashion, and construction is also taken to make the discharge ports of the second, fourth and sixth hydraulic pumps 13, 15, 17 connectable to the passages 212, 214, 216 of the closed circuits A, B, C, wherein construction is further taken to make the second, fourth and the sixth hydraulic pump 13, 15, 17 connectable in an open-circuit fashion so as to connect the suction sides thereof to the tank 25.

This results in enabling each one single rod hydraulic cylinder of the boom cylinder 1, the arm cylinder 3 and the bucket cylinder 5 to exclusively possess the closed-circuit first, third and fifth hydraulic pumps 12, 14, 16 and the open-circuit second, fourth and the sixth hydraulic pumps 13, 15, 17 one by one. Therefore, because it becomes possible to properly control the hydraulic oil flow rate flowing to these boom cylinder 1, arm cylinder 3 and bucket cylinder 5 without being influenced by the pressure fluctuation to which hydraulic oil is subjected when other single rod hydraulic cylinders, the swivel mechanism 7 and the traveling devices 8*a*, 8*b* are driven, the hydraulic excavator 1 that ensures excellent maneuverability can be obtained.

Further, where, during an independent operation of the boom for example, no other hydraulic cylinders such as the arm cylinder 3 and the bucket cylinder 5 except for the boom cylinder 1 for driving the boom 2 are being driven, it becomes possible to suitably drive the third, fifth and the seventh hydraulic pumps 14, 16, 18 that are those other than the first hydraulic pump 12 for driving the boom cylinder 1, so that the discharge flow rates from these third, fifth and seventh hydraulic pumps 14, 16, 18 can be joined together to drive the boom cylinder 1. Accordingly, since the hydraulic oil of the flow rate that is necessary to drive the boom cylinder 1 can stably be supplied to the boom cylinder 1, the boom cylinder 1 can be stabilized in driving speed and can be improved in maneuverability. Further, as is done to the boom cylinder 1, hydraulic oil can stably be supplied also to the arm cylinder 3 and the bucket cylinder 4, so that these boom cylinder 1, arm cylinder 3 and bucket cylinder 5 can be stabilized in driving speed and can be improved in maneuverability.

Further, during combined operations wherein in addition to the boom cylinder 1, the arm cylinder 3, the bucket cylinder 5, the swivel mechanism 7 and the traveling devices 8*a*, 8*a* are operated in combination, the connection destinations of the first through eighth hydraulic pumps 12, 13, . . . , 19 are distributed to these boom cylinder 1, arm cylinder 3, bucket cylinder 5, swivel mechanism 7 and traveling devices 8*a*, 8*b*, so that combined operations, for example, six combined operations in the largest number are possible in correspondence to the number of the hydraulic actuators including these boom cylinder 1, arm cylinder 3, bucket cylinder 5, swivel mechanism 7 and traveling devices 8*a*, 8*b*. Incidentally, in the combination operations, it may be done to prepare a priority order map for the hydraulic actuators which are connected to the first through eight hydraulic pumps 12, 13, . . . , 19 so that many hydraulic pumps are connected on a priority basis to a hydraulic actuator being high in operation frequency, for example, to the boom cylinder 1 or the like with the result that the hydraulic oils discharged from the first through eighth hydraulic pumps 12, 13, . . . , 19 can join together, and to control the connection destinations to these first through eighth hydraulic pumps 12, 13, . . . , 19.

Particularly, in the foregoing first embodiment, the controller 57 controls the discharge flow rates of the first through eighth hydraulic pumps 12, 13, . . . , 19 in correspondence to the manipulated variables at the control lever device 56 to supply the hydraulic oils of the flow rates that are necessary to drive the boom cylinder 1, the arm cylinder 3, the bucket cylinder 5 and the swivel mechanism 7. Accordingly, in the passages 212, 213, . . . , 219 connected to these boom cylinder 1, arm cylinder 3, bucket cylinder 5 and swivel mechanism 7, it is possible to make throttles such as control valves that are for regulating the flow rates of hydraulic oils supplied to these passages 212, 213, . . . , 219 unnecessary. Therefore, since there is eliminated a pressure loss that occurs in the hydraulic oil by providing such throttles, the driving power of the engine 9 can be utilized efficiently, and the engine 9 can be improved in fuel efficiency.

On the other hand, in the case of a hydraulic circuit of the closed-circuit type wherein, for example, the bottom chamber 1*a* and the rod chamber 1*b* of the boom cylinder 1 are connected in a closed-circuit fashion to the pair of input and output ports of the hydraulic pump 12 capable of discharging hydraulic oil bidirectionally and wherein during the operation of the boom cylinder 1, the charge pump 11 and the flushing valve 34 compensate the difference between the flow rate of the hydraulic oil supplied to the boom cylinder 1 and the flow rate of the hydraulic oil discharged from the boom cylinder 1, the hydraulic oil pressure in the boom cylinder 1 is hard to be stabilized, and hence, an anxiety may arise in that the flow rate of the hydraulic oil supplied to the boom cylinder 1 does not become stable, thereby resulting in degrading the maneuverability.

On the contrary, in the foregoing first embodiment, each hydraulic cylinder of the boom cylinder 1, the arm cylinder 3 and the bucket cylinder 5 is connected to two in pair of the hydraulic pumps 12, 13, . . . , 19 attached to the open circuits A, B, C, D and the closed circuits E, F, G, H, and under the aforementioned pressurized area ratio control, the discharge flow rates of these two hydraulic pumps 12, 13, . . . , 19 in total are controlled to meet the difference in the pressurized areas between the bottom chamber 1*a*, 3*a*, 5*a* and the rod chamber 1*b*, 3*b*, 5*b* of a corresponding one of the boom cylinder 1, the arm cylinder 3 and the bucket cylinder 5. As a consequence, because during the driving of these boom cylinder 1, arm cylinder 3 and bucket cylinder 5, it becomes possible to stabilize the ratio of the flow rate of the hydraulic oil supplied to these boom cylinder 1, arm cylinder 3 and bucket cylinder 5 to the flow rate of the hydraulic oil discharged from these boom cylinder 1, arm cylinder 3 and bucket cylinder 5, these boom cylinder 1, arm cylinder 3 and bucket cylinder 5 can be stabilized in operation and can be improved in operability.

Further, by using the first through eighth hydraulic pumps 12, 13, . . . , 19 being eight in total, it becomes possible to drive these boom cylinder 1, arm cylinder 3, bucket cylinder 5, swivel mechanism 7 and traveling devices 8*a*, 8*b* simultaneously and independently with a energy-saving capability secured in the boom cylinder 1, the arm cylinder 3, the bucket cylinder 5 and the swivel mechanism 7. Furthermore, it is possible to control the individual flow rate from the respective hydraulic pumps 12, 13, . . . , 19 which are paired by two to be connected to the boom cylinder 1, the arm cylinder 3 and the bucket cylinder 5. Accordingly, even in the case of being connected to the boom cylinder 1, the arm cylinder 3 or the bucket cylinder 5 that have the difference in the pressurized areas at the bottom chamber 1*a*, 3*a*, 5*a* and the rod chamber 1*b*, 3*b*, 5*b*, the discharge flow rates of two hydraulic pumps 12, 13, . . . , 19 are subjected to the aforementioned pressurized area ratio control to meet the difference in the pressurized areas of each cylinder, and thus, these boom cylinder 1, arm cylinder 3 and bucket cylinder 5 can be stabilized in operation and can acquire excellent operability.

Where hydraulic pumps paired by two are independently used to be connected to each of the boom cylinder 1, the arm cylinder 3 and the bucket cylinder 5, it is required that these hydraulic pumps paired by two have displacements capable of outputting the maximum speed of each of the boom cylinder 1, the arm cylinder 3 and the bucket cylinder 5. To this end, in the foregoing first embodiment, the respective first through eighth hydraulic pumps 12, 13, . . . , 19 are connected to one another by the coupling passages 301, 302, 303, 304, and the selector valves 43*a*, 44*a*, . . . , 50*a*, 43*b*, 44*b*, . . . , 50*b*, 43*c*, 44*c*, . . . , 50*c*, 43*d*, 44*d*, . . . , 50*d* are connected to these coupling passages 301, 302, 303, 304, so that it is possible to connect a plurality of hydraulic pumps to each of these boom cylinder 1, arm cylinder 3 and bucket cylinder 5. Consequently, in making each hydraulic actuator output the maximum speed, the hydraulic oils discharged from the hydraulic pumps of plural pairs can be joined together and can be supplied, and each hydraulic actuator can be driven in effective use of all of the first, third, fifth and seventh hydraulic pumps 12, 14, 16, 18 connected respectively to the plural closed circuits E, F, G, H. As a consequence, it becomes possible to downsize the displacement per one hydraulic pump in comparison with the case where the driving is performed independently using hydraulic pumps paired by two.

Further, the construction is taken that in addition to the second, fourth, sixth and eighth hydraulic pumps 13, 15, 17, 19 connected to the respective open circuits A, B, C, D, the flow control valves 64, 65, 66, 67 are provided on the conduits branching from the passages 202, 205, 208, 211 which connect these second, fourth, sixth and eighth hydraulic pumps 13, 15, 17, 19 to the selector valves 44*a*, 44*b*, 44*c*, 44*d*, 46*a*, 46*b*, 46*c*, 46*d*, 48*a*, 48*b*, 48*c*, 48*d*, 50*a*, 50*b*, 50*c*, 50*d*, and leading to the tank 25, and that the controller 57 controls these flow control valves 64, 65, 66, 67. As a consequence, when the operation is performed for boom-down, arm-dump or bucket-dump, the controller 57 performs the aforementioned pressurized area ratio control, whereby the ratios of the discharge flow rates of the first, third, fifth and seventh hydraulic pumps 12, 14, 16, 18 to the drain flow rates of the flow control valves 64, 65, 66, 67 are controlled to be varied as the predetermined relation is maintained. Thus, since the flow rates of the hydraulic oils that flow out from the respective open circuits A, B, C, D to the predetermined boom cylinder 1, arm cylinder 3 and bucket cylinder 5 can be controlled more precisely, these boom cylinder 1, arm cylinder 3 and bucket cylinder 5 can be stabilized in moving speed. Therefore, these boom cylinder 1, arm cylinder 3 and bucket cylinder 5 can be further improved in operability.

Second Embodiment

Figure 5:
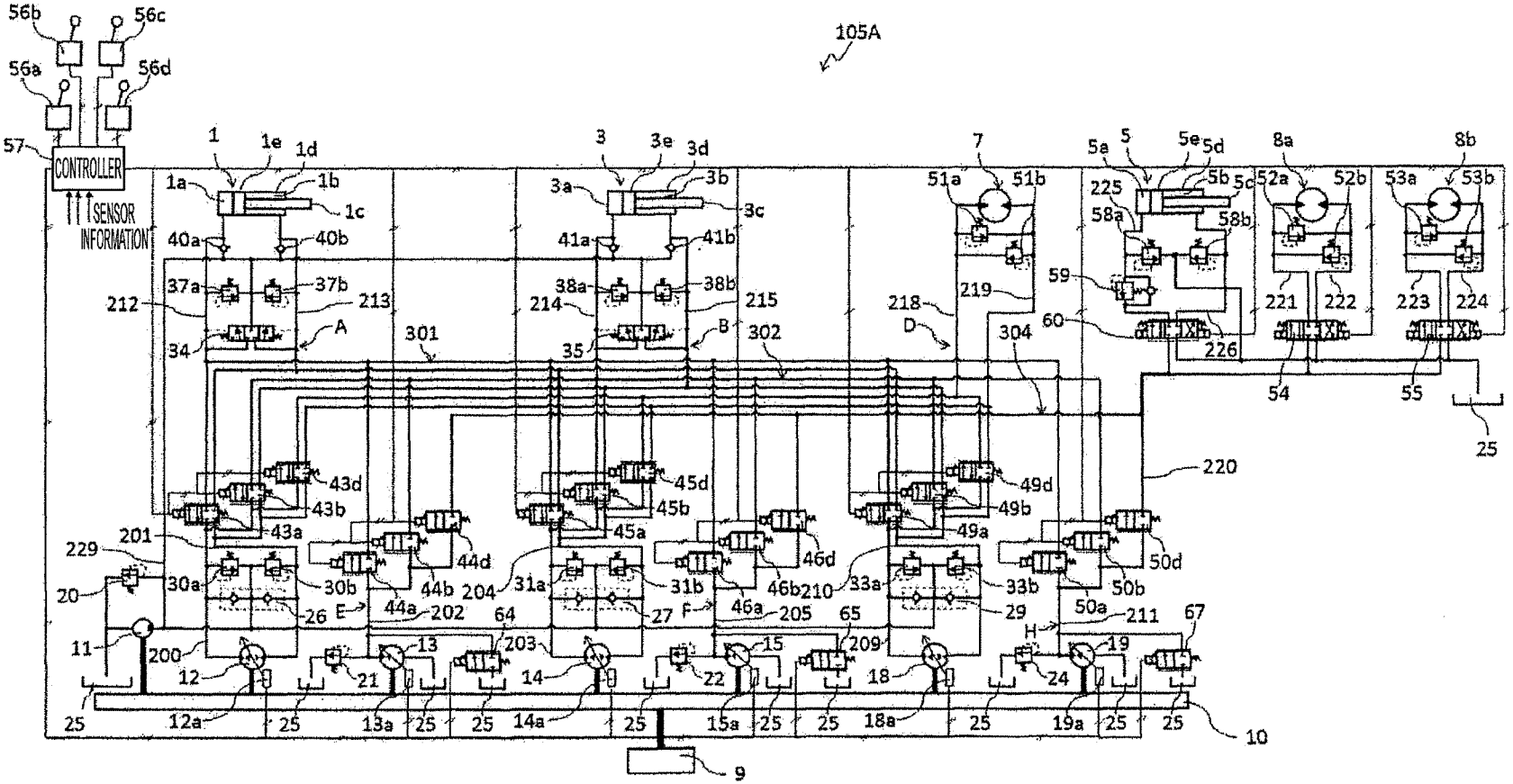
FIG. 5 is a schematic view showing the system construction of a driving device for a work machine according to a second embodiment of the present invention.

FIG. 5 is a schematic view showing the system construction of a hydraulic drive system 105A according to a second embodiment of the present invention. The difference of the present second embodiment from the foregoing first embodiment resides in that although the first embodiment is designed as the hydraulic drive system 10 wherein the closed circuit C is configured to connect the seventh hydraulic pump 18 to the bucket cylinder 5 in a closed-circuit fashion, the second embodiment is designed as the hydraulic drive system 105A wherein the bucket cylinder 5 is connected to the passage 220 for the purpose of reducing the number of the hydraulic pumps instead of seeking the energy-saving capability of the bucket 6. Incidentally, in the present second embodiment, the same symbols are given to the parts that are identical with or correspond to those in the first embodiment.

<Construction>

Specifically, the present second embodiment is designed as the hydraulic drive system 105A provided with six hydraulic pumps in total, that is, the first to sixth hydraulic pumps 12, 13, . . . , 17. Then, a proportional selector valve 60 as a control valve that controls the supply and discharge of hydraulic oil to and from the bucket cylinder 5 is connected between a passage 225 connected to the head chamber 5*a* of the bucket cylinder 5 and a passage 226 connected to the rod chamber 5*b* of the bucket cylinder 5. The proportional selector valve 60 is connected through the passage 220 and the passage 229 connected to the tank 25 in parallel with the proportional selector valves 54, 55 attached to the traveling devices 8*a*, 8*b*.

Further, between the passages 225 and 226, there are connected relief valves 58*a* and 58*b*. The relief valves 58*a*, 58*b* let the hydraulic oils in the passages 225, 226 go into the tank 25 to protect the passages 225, 226 when the hydraulic oils in the passages 225, 226 become a predetermined pressure or higher. Further, the passage 225 is connected to a counterbalance valve 59. The counterbalance valve 59 is connected to the head chamber 5*a* of the bucket cylinder 5 through the passage 225 and restrains the bucket cylinder 5 from falling by the dead weight.

Furthermore, the proportional selector valve 60 is for switching each connection destination of the passage 220 and the tank 25 to the passage 226 or the counterbalance valve 59 in response to a control signal outputted from the controller 57 and is adjustable in flow rate. Therefore, the bucket cylinder 5 is configured to extend or contract upon receiving the hydraulic oil from the proportional selector valve 60.

<Advantageous Effects>

As described above, in the hydraulic drive system 105A according to the foregoing second embodiment, the bucket cylinder 5 is connected through the proportional selector valve 60 to the passage 220, and this makes the seventh and eighth hydraulic pumps 18, 19 used in the hydraulic drive system 105 according to the foregoing first embodiment unnecessary, so that the first through sixth hydraulic pumps 12, 13, . . . , 17 being six in total make it possible to improve the boom cylinder 1, the arm cylinder 3 and the swivel mechanism 7 in operability. Further, by the use of these first through sixth hydraulic pumps 12, 13, . . . , 17 being six in total, it is possible to secure the energy-saving capability of the boom cylinder 1, the arm cylinder 3 and the swivel mechanism 7 and at the same time, to drive these boom cylinder 1, arm cylinder 3, bucket cylinder 5, swivel mechanism 7 and traveling devices 8*a*, 8*b* simultaneously and independently.

Third Embodiment

Figure 6:
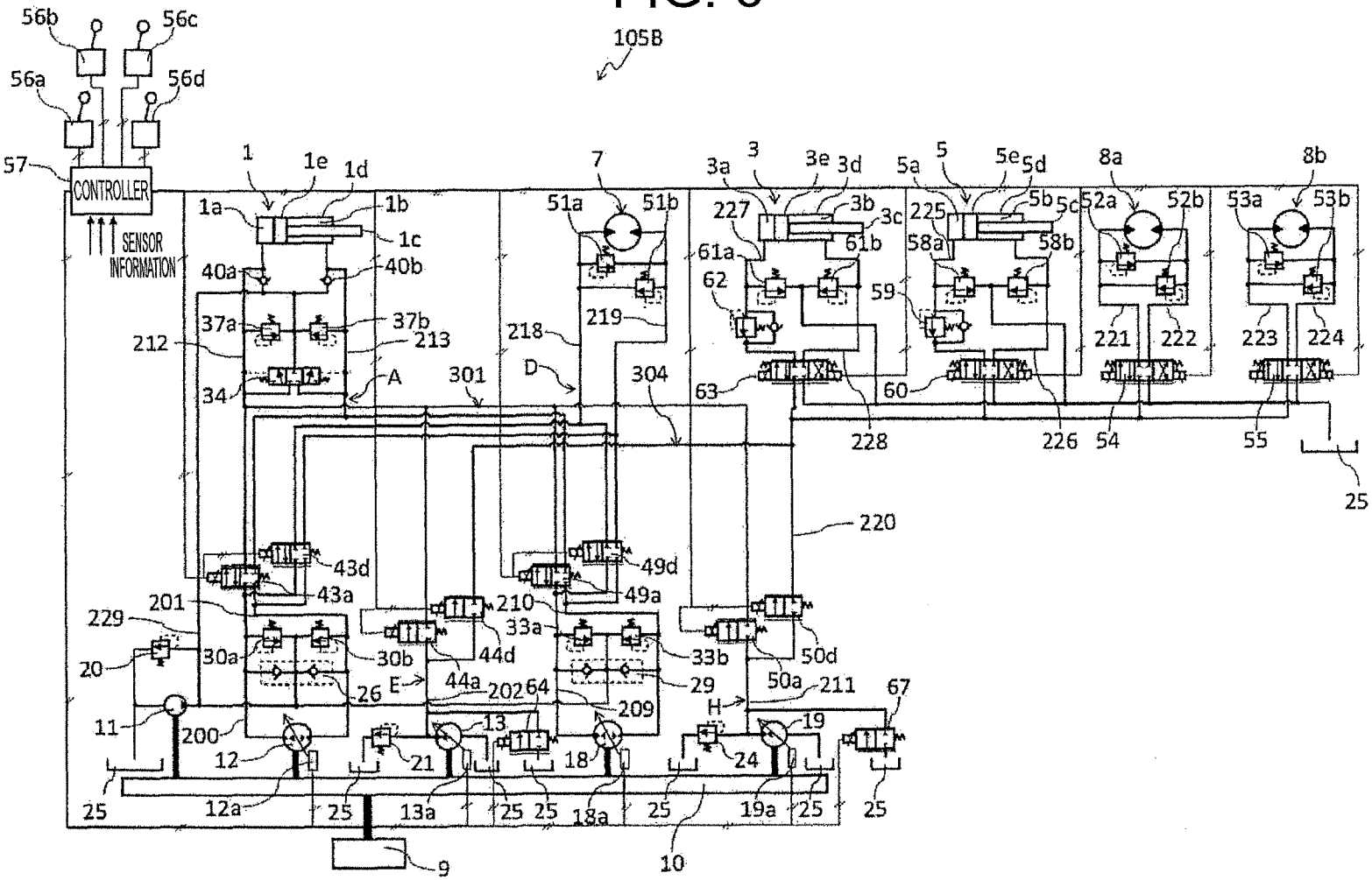
FIG. 6 is a schematic view showing the system construction of a driving device for a work machine according to a third embodiment of the present invention.

FIG. 6 is a schematic view showing the system construction of a hydraulic drive system 105B according to a third embodiment of the present invention. The difference of the present third embodiment from the foregoing second embodiment resides in that although the second embodiment is designed as the hydraulic drive system 105A wherein the open circuit H is configured to connect the bucket cylinder 5 to the passage 220, the third embodiment is designed as the hydraulic drive system 105B wherein the arm cylinder 3 is connected to the passage 220 for the purpose of further reducing the number of the hydraulic pumps instead of seeking the energy-saving capability of the arm 4. Incidentally, in the present third embodiment, the same symbols are given to the parts that are identical with or correspond to those in the second embodiment.

<Construction>

Specifically, the present third embodiment is designed as the hydraulic drive system 105B provided with four hydraulic pumps in total, that is, the first to four hydraulic pumps 12, 13, 14, 15. Then, a proportional selector valve 63 as a control valve that controls the supply and discharge of hydraulic oil to and from the arm cylinder 3 is connected between a passage 227 connected to the head chamber 3*a* of the arm cylinder 3 and a passage 228 connected to the rod chamber 3*b* of the arm cylinder 3. The proportional selector valve 63 is connected to the passages 220 and 229.

Then, between the passages 227 and 228, there are connected relief valves 61*a* and 61*b*. The relief valves 61*a*, 61*b* let the hydraulic oils in the passages 227, 228 go into the tank 25 to protect the passages 227, 228 when the hydraulic oils in the passages 227, 228 become a predetermined pressure or higher. Further, the passage 227 is connected to a counterbalance valve 62. The counterbalance valve 62 is connected to the head chamber 3*a* of the arm cylinder 3 through the passage 227 and restrains the arm cylinder 3 from falling by the dead weight.

Furthermore, the proportional selector valve 63 is for switching each connection destination of the passage 220 and the tank 25 to the passage 228 or the counterbalance valve 62 in response to a control signal outputted from the controller 57 and is adjustable in flow rate. Therefore, the arm cylinder 3 is configured to extend or contract upon receiving the hydraulic oil from the proportional selector valve 63.

<Advantageous Effects>

As described above, in the hydraulic drive system 105B according to the foregoing third embodiment, in addition to the bucket cylinder 5, the arm cylinder 3 is connected through the proportional selector valve 63 to the passage 220, and this makes the fifth and sixth hydraulic pumps 16, 17 used in the hydraulic drive system 105A according to the foregoing second embodiment unnecessary, so that the first through fourth hydraulic pumps 12, 13, 14, 15 being four in total make it possible to improve the boom cylinder 1 and the swivel mechanism 7 in operability. Further, by the use of these first through fourth hydraulic pumps 12, 13, 14, 15 being four in total, it is possible to secure the energy-saving capability of the boom cylinder 1 and the swivel mechanism 7 and at the same time, to drive these boom cylinder 1, arm cylinder 3, bucket cylinder 5, swivel mechanism 7 and traveling devices 8*a*, 8*b* simultaneously and independently.

[Others]

Incidentally, it is to be noted that the present invention is not limited to the foregoing embodiments and may encompass various modified forms. For example, the foregoing embodiments have been described for the purpose of describing the present invention to be easily understood, and the present invention is not necessarily limited to those provided with all of the described constructions.

Then, although in each of the foregoing embodiments, description has been made taking as an example the case where the hydraulic drive system 105, 105A, 105B is mounted on the hydraulic excavator 1, the present invention is not limited to this. For example, the hydraulic drive system 105, 105A, 105B according to the present invention can be used also in any other work machine than the hydraulic excavator 1 as long as the work machine is provided with at least one single rod hydraulic cylinder that can be driven in a hydraulic circuit, as is the case of, for example, a hydraulic crane, a wheel loader or the like.

Further, although in each of the foregoing embodiments, the hydraulic pumps with the double-tilting swash plate mechanism capable of controlling the outflow/inflow direction and the flow rate are used as the second, fourth, sixth and eighth hydraulic pumps 13, 15, 17, 19, there may be used hydraulic pumps with a single-tilting swash plate mechanism capable of discharging hydraulic oils in one direction only that goes from the tank 25 toward the selector valves 44*a*, 44*b*, 44*c*, 44*d*, 46*a*, 46*b*, 46*c*, 46*d*, 48*a*, 48*b*, 48*c*, 48*d*, 50*a*, 50*b*, 50*c*, 50*d*.

Further, in each of the foregoing embodiments, the plurality of first through eighth hydraulic pumps 12, 13, . . . , 19 each with the double-tilting swash plate mechanism are configured to be connected to the one engine 9 through the power transmission device 10. However, there may also be taken a construction that a plurality of hydraulic pumps of the fixed displacement type are provided as these first through eighth hydraulic pumps 12, 13, . . . , 19 and are coupled with electric motors which are controllable in rotational direction and rotational speed and that the controller 57 controls these electric motors to control the outflow/inflow directions and the discharge flow rates of hydraulic oil in dependence on the rotational directions and the rotational speeds of the respective hydraulic pumps of the fixed displacement type.

Furthermore, in each of the foregoing embodiments, the selector valves 44*a*, 44*b*, 44*c*, 44*d*, 46*a*, 46*b*, 46*c*, 46*d*, 48*a*, 48*b*, 48*c*, 48*d*, 50*a*, 50*b*, 50*c*, 50*d*, the directional selector valves 54, 55, 60, 63 and the flow control valves 64, 65, 66, 67, although having been described as being directly controlled in response to the signals outputted from the controller 57, are not limited to such direct control and may be controlled in response to, for example, hydraulic signals into which the signals from the controller 57 are converted by the use of electromagnetic reducing valves or the like.

REFERENCE SIGNS LIST

1: boom cylinder (single rod hydraulic cylinder)
1*a*: bottom chamber (first hydraulic oil chamber)
1*b*: rod chamber (second hydraulic oil chamber)
1*c*: rod
1*d*: cylinder tube
1*e*: piston
2: boom
3: arm cylinder (single rod hydraulic cylinder)
3*a*: head chamber (first hydraulic oil chamber)
3*b*: rod chamber (second hydraulic oil chamber)
3*c*: rod
3*d*: cylinder tube
3*e*: piston
4: arm
5: bucket cylinder (single rod hydraulic cylinder)
5*a*: head chamber (first hydraulic oil chamber)
5*b*: rod chamber (second hydraulic oil chamber)
5*c*: rod
5*d*: cylinder tube
5*e*: piston
6: bucket
7: swivel mechanism
8*a*, 8*b*: traveling device
9: engine
10: power transmission device
11: charge pump
12: first hydraulic pump (closed-circuit hydraulic oil outflow/inflow control section)
12*a*: regulator
13: second hydraulic pump (open-circuit hydraulic oil outflow/inflow control section, open-circuit hydraulic pump)
13*a*: regulator
14: third hydraulic pump (closed-circuit hydraulic oil outflow/inflow control section)
14*a*: regulator
15: fourth hydraulic pump (open-circuit hydraulic oil outflow/inflow control section, open-circuit hydraulic pump)
15*a*: regulator
16: fifth hydraulic pump (closed-circuit hydraulic oil outflow/inflow control section)
16*a*: regulator
17: sixth hydraulic pump (open-circuit hydraulic oil outflow/inflow control section, open-circuit hydraulic pump)
17*a*: regulator
18: seventh hydraulic pump (closed-circuit hydraulic oil outflow/inflow control section)
18*a*: regulator
19: eighth hydraulic pump (open-circuit hydraulic oil discharge/drawing control section, open-circuit hydraulic Pump)
19*a*: regulator
20: charger relief valve
21, 22, 23, 24: relief valve
25: tank
26, 27, 28, 29: charge check valve
30*a*, 30*b*: relief valve
31*a*, 31*b*: relief valve
32*a*, 32*b*: relief valve
33*a*, 33*b*: relief valve
34, 35, 36: flushing valve
37*a*, 37*b*: relief valve
38*a*, 38*b*: relief valve
39*a*, 39*b*: relief valve
40*a*, 40*b*: charge check valve
41*a*, 41*b*: charge check valve
42*a*, 42*b*: charge check valve
43*a*, 43*b*, 43*c*, 43*d*: selector valve
44*a*, 44*b*, 44*c*, 44*d*: selector valve (open-circuit switching section)

45*a*, 45*b*, 45*c*, 45*d*: selector valve
46*a*, 46*b*, 46*c*, 46*d*: selector valve (open-circuit switching section)
47*a*, 47*b*, 47*c*, 47*d*: selector valve
48*a*, 48*b*, 48*c*, 48*d*: selector valve (open-circuit switching section)
49*a*, 49*b*, 49*c*, 49*d*: selector valve
50*a*, 50*b*, 50*c*, 50*d*: selector valve (open-circuit switching section)
51*a*, 51*b*: relief valve
52*a*, 52*b*: relief valve
53*a*, 53*b*: relief valve
54, 55: proportional selector valve
56: control lever device
56*a*, 56*b*, 56*c*, 56*d*: control lever
57: controller (control section)
58*a*, 58*b*: relief valve
59: counterbalance valve
60: proportional selector valve
61*a*, 61*b*: relief valve
62: counterbalance valve
63: proportional selector valve
64, 65, 66, 67: flow control valve (flow adjusting valve)
100: hydraulic excavator (work machine)
101: cab
102: upper rotating body
103: lower traveling body
104: front working assembly
105, 105A, 105B: hydraulic drive system (driving device)
200, 201: passage
202: passage (conduit)
203, 204: passage
205: passage (conduit)
206, 207: passage
208: passage (conduit)
209, 210: passage
211: passage (conduit)
212, 213, . . . , 229: passage
301, 302, 303, 304: coupling passage (connection passage)
305*a*, 305*b*, 305*c*, 305*d*: open-circuit connection passage
306*a*, 306*b*, 306*c*, 306*d*: open-circuit connection passage
307*a*, 307*b*, 307*c*, 307*d*: open-circuit connection passage
308*a*, 308*b*, 308*c*, 308*d*: open-circuit connection passage
309*a*, 309*b*, 309*c*, 309*d*: closed-circuit connection passage
A, B, C, D: closed circuit
E, F, G, H: open circuit

The invention claimed is:

1. A driving device for a work machine, comprising:

a plurality of closed circuits including a closed-circuit hydraulic oil outflow/inflow control section having two outflow/inflow ports enabling the outflow/inflow of hydraulic oil in both directions, and a single rod hydraulic cylinder having a first hydraulic oil chamber and a second hydraulic oil chamber, the two outflow/inflow ports of the closed-circuit hydraulic oil outflow/inflow control section being connected to the first hydraulic oil chamber and the second hydraulic oil chamber to form the closed circuit; and a plurality of open circuits including an open-circuit hydraulic oil outflow/inflow control section having an inflow port in which hydraulic oil flows from a tank, and an outflow port from which hydraulic oil flows out, and an open-circuit switching section that is connected to the open-circuit hydraulic oil outflow/inflow control section and switches supply destinations of the hydraulic oil flowing out from the open-circuit hydraulic oil outflow/inflow control section to any of the plurality of the closed circuits; wherein the open-circuit hydraulic oil outflow/inflow control section and the open-circuit switching section are respectively provided in a plurality of numbers so as to correspond to the plurality of the closed circuits, a controller that controls a plurality of the closed-circuit hydraulic oil outflow/inflow control sections, a plurality of the open-circuit hydraulic oil outflow/inflow control sections, and a plurality of the open-circuit switching sections is further provided, and the controller controls the plurality of the open-circuit switching sections such that the plurality of the closed circuits are respectively connected to any of the plurality of the open circuits.

2. The driving device for the work machine according to claim 1, wherein the closed circuits and the open circuits are provided to be paired.

3. The driving device for the work machine according to claim 2, wherein the controller controls a first flow rate of the closed-circuit hydraulic oil outflow/inflow control section on a side connected to the first hydraulic oil chamber and the second hydraulic oil chamber of the single rod hydraulic cylinder and a second flow rate of the open-circuit hydraulic oil outflow/inflow control section connected through the open-circuit switching section to a connection passage that connects a side from which hydraulic oil of the open-circuit switching section of the plurality of the open circuits flows out to any of the plurality of the closed circuits so that the ratio of the first flow rate to the second flow rate becomes a predetermined value which is determined beforehand in correspondence to pressurized areas at the first hydraulic oil chamber and the second hydraulic oil chamber of the single rod hydraulic cylinder.

4. The driving device for the work machine according to claim 1, wherein the controller controls a first flow rate of the closed-circuit hydraulic oil outflow/inflow control section on a side connected to the first hydraulic oil chamber and the second hydraulic oil chamber of the single rod hydraulic cylinder and a second flow rate of the open-circuit hydraulic oil outflow/inflow control section connected through the open-circuit switching section to a connection passage that connects a side from which hydraulic oil of the open-circuit switching section of the plurality of the open circuits flows out to any of the plurality of the closed circuits so that the ratio of the first flow rate to the second flow rate becomes a predetermined value determined in correspondence to pressurized areas at the first hydraulic oil chamber and the second hydraulic oil chamber of the single rod hydraulic cylinder.

5. The driving device for the work machine according to claim 4, wherein the open-circuit hydraulic oil outflow/inflow control section includes: an open-circuit hydraulic pump capable of controlling a discharge flow rate of hydraulic oil; and a flow rate adjusting valve provided on a first conduit branching from a second conduit that connects the open-circuit switching section to the open-circuit hydraulic pump, and the first conduit leading to the tank.

* * * * *